US011835875B2

(12) United States Patent
Yamashita et al.

(10) Patent No.: US 11,835,875 B2
(45) Date of Patent: Dec. 5, 2023

(54) TONER CLASSIFICATION APPARATUS AND TONER PRODUCTION METHOD

(71) Applicant: CANON KABUSHIKI KAISHA, Tokyo (JP)

(72) Inventors: Daisuke Yamashita, Chiba (JP); Junichi Tamura, Ibaraki (JP); Ran Wakayama, Kanagawa (JP); Katsuyuki Katoh, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/890,877

(22) Filed: Aug. 18, 2022

(65) Prior Publication Data

US 2023/0083576 A1 Mar. 16, 2023

(30) Foreign Application Priority Data

Aug. 24, 2021 (JP) ..... 2021-136137

(51) Int. Cl.
*G03G 15/08* (2006.01)
*G03G 9/08* (2006.01)
*B07B 7/083* (2006.01)

(52) U.S. Cl.
CPC ..... *G03G 15/0887* (2013.01); *B07B 7/083* (2013.01); *G03G 9/0817* (2013.01)

(58) Field of Classification Search
CPC .. G03G 15/0887; G03G 9/0817; G03G 15/06; B07B 7/083
See application file for complete search history.

(56) References Cited

U.S. PATENT DOCUMENTS

2021/0397104 A1 12/2021 Yamashita et al. ..... G03G 9/08
2022/0179332 A1 6/2022 Yamashita et al. ..... G03G 9/08

FOREIGN PATENT DOCUMENTS

JP H07112161 A * 5/1995
JP 2001-201890 7/2001
JP 2008-026457 2/2008
JP 2010-160374 7/2010
JP 2010227924 A * 10/2010 ..... B07B 4/02
JP 2011-237816 11/2011

OTHER PUBLICATIONS

English machine translation of JP 2010227924 A (Year: 2010).*
English machine translation of JP H07112161 A (Year: 1995).*

* cited by examiner

*Primary Examiner* — Walter L Lindsay, Jr.
*Assistant Examiner* — Geoffrey T Evans
(74) *Attorney, Agent, or Firm* — Venable LLP

(57) ABSTRACT

A toner classification apparatus comprising a classification rotor in which the classification rotor has a vane A which extends from a rotation center direction of the classification rotor to an outer circumference direction thereof and a vane B having a length longer than that of the vane A, the vane A, and the vane B are disposed so as to satisfy a predetermined relationship, and a toner production method comprising a classification step of carrying out a classification process on particles to be classified by using the toner classification apparatus.

9 Claims, 15 Drawing Sheets

TONER CLASSIFICATION APPARATUS AND TONER PRODUCTION METHOD

BACKGROUND OF THE INVENTION

Field of the Invention

The present disclosure relates to a toner classification apparatus that is used in an electrophotographic system, an electrostatic recording system, and a toner jet system, and to a toner production method.

Description of the Related Art

In recent years, full color electrophotographic copiers have become widely disseminated and have also begun to be used in the commercial printing market. The commercial printing market requires high speeds, high image quality, and high productivity, while accommodating a broad range of media (paper types). With regard to toner, an increased image quality can be pursued through stabilization of the developing performance and transferability based on, inter alia, a stabilization of the charging performance provided by toner that has a small particle size and a sharp particle size distribution.

The melt-kneading/pulverization method is known as one of the common toner production methods. A specific example of a toner particle production method using the melt-kneading/pulverization method is as follows. Toner starting materials, e.g., binder resin, colorant, release agent, and so forth, are melt-kneaded followed by cooling and solidification and then microfine-sizing of the kneadate using pulverization means to obtain a toner particle. As necessary, this is followed by, e.g., classification into a desired particle size distribution, adjustment of the circularity by toner particle spheronization using a heat treatment, and addition of a fluidizing agent such as inorganic fine particles, to produce the toner.

A variety of pulverization apparatuses are used as kneadate pulverization means. For example, the mechanical pulverization apparatus in Japanese Patent Application Laid-open No. 2011-237816 is a mechanical pulverization apparatus that is provided with a casing having an outlet port and an inlet port for the material to be pulverized. The following are provided within this casing: a rotor supported on a central rotational axle and having on its outer peripheral surface a plurality of protruded portions and depressed portions, and a fixed element which is disposed to the outside of this rotor at a prescribed gap from the outer peripheral surface of the rotor and which has on its inner peripheral surface a plurality of protruded portions and depressed portions. While a material to be pulverized is being carried on an air flow from the inlet port to the outlet port and is passing through a processing space, where the rotor and fixed element face each other, the material to be pulverized is pulverized by impact with the protruding portions or depressed portions of the rotor or fixed element.

In addition, particles generated during the pulverization step and having too small diameter are admixed in the pulverized material provided by pulverization, by the pulverization apparatus, to the desired particle diameter. These particles having too small diameter, when present in toner, create problems for the electrophotographic process, e.g., fogging and so forth, and due to this the particles having too small diameter are generally removed by a classification process.

The following, for example, are known as toner production methods that have a classification process that uses a classification apparatus: the toner production method described in Japanese Patent Application Laid-open No. 2001-201890, which uses an air flow classification apparatus that employs the Coanda effect, and the toner production method described in Japanese Patent Application Laid-open No. 2008-26457, which uses a centrifugal wind force classifier.

When a centrifugal wind force classifier is used, the pulverized material—which comprises the particles to be classified and derives from the toner starting material kneadate—is transported from the inlet port to the vicinity of the outer circumference of a classification rotor by an air flow that is directed from the outer circumference side to the inside of the classification rotor. Due to the rotation of the classification rotor, a centrifugal force is applied at the outer circumference of the classification rotor. The centrifugal force acting on the particles to be classified is a force directed to the outside of the classification rotor and is proportional to the particle weight, and due to this the centrifugal force acting on the particles having too small diameter in the particles to be classified is smaller than the drag imparted by the air flow directed from the outer circumference side to the inside of the classification rotor. As a consequence, classification proceeds as follows: a classified material is obtained by removal of the particles having too small diameter from the particles to be classified by passage between the vanes of the classification rotor and recovery by means for recovering particles having too small diameter that communicates with the inside of the classification rotor, and the classified material from which the particles having too small diameter have been thusly removed is recovered using classified material recovery means disposed to the outside of the classification rotor.

Japanese Patent Application Laid-open No. 2010-160374 also proposes a toner production method, which uses classification means that has a plurality of vanes lined up at a certain interposed gap on the same circumference, with each vane making an angle θ with respect to the straight line connecting the center of the classification rotor with the tip of the vane. The classification means used in this production method causes the generation of a vortex by dividing the air entering between the vanes from the outside of the rapidly rotating classification rotor into a component in the direction of the center of rotation and a component expelled to the outside of the classification rotor.

SUMMARY OF THE INVENTION

As noted above, the classification process is performed by adjusting the balance between the drag force and centrifugal force acting on the particles to be classified. However, in some cases particles that should not be taken in as particles having too small diameter also end up being suctioned off and removed in error; this occurs due to factors such as the occurrence of turbulence in the air flow in the classification apparatus, the occurrence of aggregation between the particles to be classified, the occurrence of variability in the velocity when the particles to be classified approach the classification rotor, and the occurrence of a vortex between the vanes of the classification rotor. As the average particle diameter of the particles to be classified approaches the particle diameter of the particles having too small diameter, which are the particles that should be removed by the classification step, the ratio of removal due to erroneous suctioning off becomes larger, and as a result a reduction in the yield for the classification step has been observed when smaller toner particle sizes are pursued.

It is thought that the vortex generated in the toner production method described in Japanese Patent Application Laid-open No. 2010-160374 is generated by the configuration along the vanes. When the angle θ is present, a vortex is generated more at the outer side of the classification rotor than for a classification rotor which is disposed on the aforementioned radial straight line, and as a consequence the ratio of erroneous suctioning off of the particles to be classified is smaller and an improved yield has been observed. However, when the formed angle θ becomes excessively large, an interval between the vanes inside the classification rotor becomes excessively small, and hence it has been determined that it becomes difficult for particles having too small diameter to pass between the vanes and, accordingly, a problem arises in that there are cases where the particles having too small diameter cannot be removed adequately and where pressure loss is increased.

As noted above, smaller particle sizes are being required of toner in order to boost the image quality. The dominant factor for the particle diameter of the ultimately obtained toner is the particle diameter of the pulverized material yielded by the pulverization step after the mixture of toner starting materials has been melt-kneaded. The particle size of the pulverized material thus has to be reduced in order to reduce the particle size of the toner. The classification step is a step in which the particles having too small diameter, which may be a problematic factor for the electrophotographic process, are removed. However, when the toner particle size is reduced, the average particle diameter of the pulverized material becomes close to the particle size of the particles having too small diameter, which are the particles that are to be removed by the classification step. As a consequence, the problem arises of a reduction in the yield due to the concomitant removal, partly as particles having too small diameter, of particles that should not be removed because they have a diameter suitable for the toner.

In addition, when classification is performed by using the centrifugal air classifier, in order to prevent the particles to be classified which should not be removed from being captured, it is conceivable to use means such as increasing the number of vanes of the classification rotor or increasing the formed angle θ with respect to the straight line which connects the center of the classification rotor and the tip of each vane. However, in these cases, a problem arises in that the pressure loss by the classification rotor is increased and a load to a blower is thereby increased.

The present disclosure solves the above problem, and provides a toner classification apparatus and a toner production method which suppress pressure loss by a classification rotor and display an excellent yield even in the case where toner having a small particle diameter is produced.

The present disclosure relates to a toner classification apparatus comprising:

a classification rotor; wherein the classification rotor comprises a plurality of vanes which extend from a rotation center direction of the classification rotor to an outer circumference direction of the classification rotor, the plurality of vanes are disposed with prescribed gaps established between the vanes;

the gaps form an opening which faces a rotation center area of the classification rotor;

the plurality of vanes comprise a first vane group constituted by a vane A and a second vane group constituted by a vane B having a length longer than a length of the vane A, the lengths of the vanes A are substantially identical to each other and the vanes A are disposed at an interval so as to follow paths which are substantially identical to each other during rotation of the classification rotor, the lengths of the vanes B are substantially identical to each other and the vanes B are disposed at an interval so as to follow paths which are substantially identical to each other during the rotation of the classification rotor, a number of the vanes A which are disposed between two adjacent vanes B is one to three, the vane B has a first elbow, the vane A and the vane B are disposed such that a portion of a vane away from of the rotation center of the classification rotor is located on more upstream direction in a direction of rotation of the classification rotor than a portion of the vane closer to the rotation center of the classification rotor, a distance between the rotation center of the classification rotor and the end portion on the side of the outer circumference of the vane A and a distance between the rotation center of the classification rotor and the end portion on the side of the outer circumference of the vane B are substantially equal to each other, a distance between the rotation center of the classification rotor and the end portion on the side of the rotation center of the vane A and a distance between the rotation center of the classification rotor and the first elbow of the vane B are substantially equal to each other, the distance between the rotation center of the classification rotor and the end portion on the side of the rotation center of the vane A is more than a distance between the rotation center of the classification rotor and the end portion on the side of the rotation center of the vane B, and, in a cross section obtained when the classification rotor is cut in a direction perpendicular to a rotation axis of the classification rotor, (i) an angle θ1)(° formed by a straight line which connects the rotation center of the classification rotor and the end portion on the side of the rotation center of the vane A and a portion on the vane A which is closer to the side of the outer circumference than the end portion on the side of the rotation center of the vane A is 40 to 65°, (ii) an angle θ3)(° formed by a straight line which connects the rotation center of the classification rotor and the first elbow of the vane B and a portion on the vane B which is closer to the side of the outer circumference than the first elbow of the vane B is substantially identical to the angle θ1, (iii) an angle θ2)(° formed by the straight line which connects the rotation center of the classification rotor and the first elbow of the vane B and a straight line which connects the end portion on the side of the rotation center of the vane B and the first elbow of the vane B satisfies $$0° \leq \theta 2 \leq \theta 3 \times \tfrac{1}{2},$$

(iv) when a radius of the classification rotor is represented by R and the distance between the rotation center of the classification rotor and the end portion on the side of the rotation center of the vane B is represented by L1, the R and the L1 satisfy $0.35 \leq L1/R \leq 0.65$, and (v) when the distance between the rotation center of the classification rotor and the first elbow of the vane B is represented by L2, the R, the L1, and the L2 satisfy $0.35 \leq (L2-L1)/(R-L1) \leq 0.70$.

The present disclosure also relates to a toner production method comprising a classification process of carrying out a classification process on particles to be classified by using a toner classification apparatus, wherein the toner classification apparatus comprising:

a classification rotor; wherein the classification rotor comprises a plurality of vanes which extend from a rotation center direction of the classification rotor to an outer circumference direction of the classification rotor, the plurality of vanes are disposed with prescribed gaps established between the vanes;

the gaps form an opening which faces a rotation center area of the classification rotor;

the plurality of vanes comprise a first vane group constituted by a vane A and a second vane group constituted by a vane B having a length longer than a length of the vane A, the lengths of the vanes A are substantially identical to each other and the vanes A are disposed at an interval so as to follow paths which are substantially identical to each other during rotation of the classification rotor, the lengths of the vanes B are substantially identical to each other and the vanes B are disposed at an interval so as to follow paths which are substantially identical to each other during the rotation of the classification rotor, a number of the vanes A which are disposed between two adjacent vanes B is one to three, the vane B has a first elbow, the vane A and the vane B are disposed such that a portion of a vane away from of the rotation center of the classification rotor is located on more upstream direction in a direction of rotation of the classification rotor than a portion of the vane closer to the rotation center of the classification rotor, a distance between the rotation center of the classification rotor and the end portion on the side of the outer circumference of the vane A and a distance between the rotation center of the classification rotor and the end portion on the side of the outer circumference of the vane B are substantially equal to each other, a distance between the rotation center of the classification rotor and the end portion on the side of the rotation center of the vane A and a distance between the rotation center of the classification rotor and the first elbow of the vane B are substantially equal to each other, the distance between the rotation center of the classification rotor and the end portion on the side of the rotation center of the vane A is more than a distance between the rotation center of the classification rotor and the end portion on the side of the rotation center of the vane B, and, in a cross section obtained when the classification rotor is cut in a direction perpendicular to a rotation axis of the classification rotor, (i) an angle θ1)(° formed by a straight line which connects the rotation center of the classification rotor and the end portion on the side of the rotation center of the vane A and a portion on the vane A which is closer to the side of the outer circumference than the end portion on the side of the rotation center of the vane A is 40 to 65°, (ii) an angle θ3)(° formed by a straight line which connects the rotation center of the classification rotor and the first elbow of the vane B and a portion on the vane B which is closer to the side of the outer circumference than the first elbow of the vane B is substantially identical to the angle θ1, (iii) an angle θ2)(° formed by the straight line which connects the rotation center of the classification rotor and the first elbow of the vane B and a straight line which connects the end portion on the side of the rotation center of the vane B and the first elbow of the vane B satisfies $0° \leq \theta 2 \leq \theta 3 \times ½$, (iv) when a radius of the classification rotor is represented by R and the distance between the rotation center of the classification rotor and the end portion on the side of the rotation center of the vane B is represented by L1, the R and the L1 satisfy $0.35 \leq L1/R \leq 0.65$, and (v) when the distance between the rotation center of the classification rotor and the first elbow of the vane B is represented by L2, the R, the L1, and the L2 satisfy $0.35 \leq (L2-L1)/(R-L1) \leq 0.70$.

According to the present disclosure, a toner classification apparatus and toner production method that demonstrate an excellent yield even in the production of small diameter toner can be provided.

Further features of the present invention will become apparent from the following description of exemplary embodiments with reference to the attached drawings.

DESCRIPTION OF THE EMBODIMENTS

Figure 1:
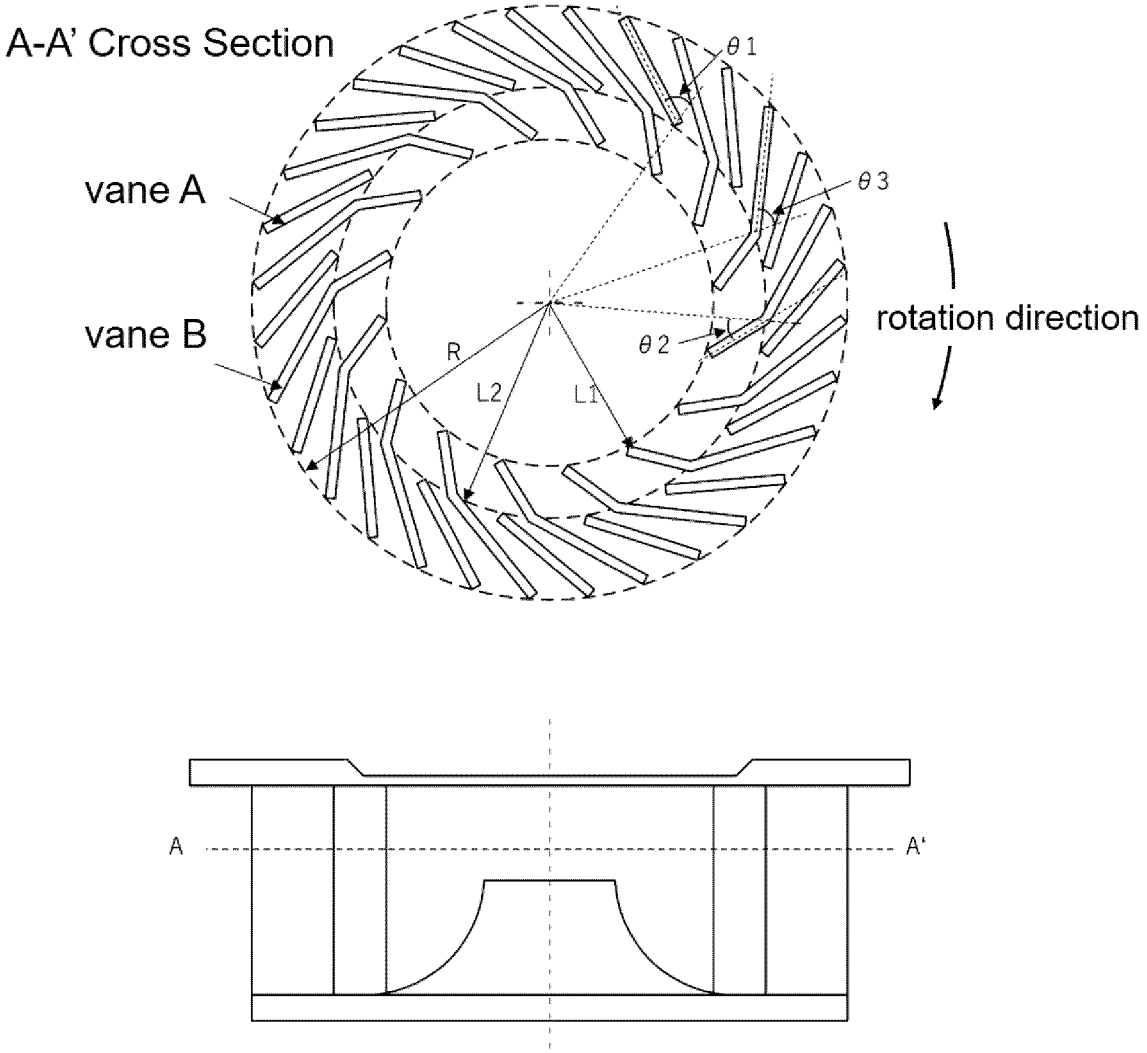
FIG. 1 is a schematic view of a classification rotor used in Example.

Unless specifically indicated otherwise, the expressions "from XX to YY" and "XX to YY" that show numerical value ranges refer in the present disclosure to numerical value ranges that include the lower limit and upper limit that are the end points. In addition, in the present disclosure, "particles having too small diameter" denotes a particle having a particle diameter which is significantly smaller than a target particle diameter.

Reference numerals in the individual drawings are as follows.

31. classification rotor, 32. dispersion rotor, 33. dispersion hammer, 34. introduction port for particles to be classified, 35. supply means for particles to be classified, 36. guide means, 37. classified material take-off port, 38. liner, 39. particles having too small diameter discharge port, 40. particles having too small diameter collection means (cyclone), 41. blower, 42. static pressure meter, 51. guide means support member FIG. 1 shows a schematic view of a classification rotor provided in a toner classification apparatus.

The classification rotor comprises a plurality of vanes which extend from a rotation center direction of the classification rotor to an outer circumference direction of the classification rotor, the plurality of vanes are disposed with prescribed gaps established between the vanes;

the gaps form an opening which faces a rotation center area of the classification rotor;

the plurality of vanes comprise a first vane group constituted by a vane A and a second vane group constituted by a vane B having a length longer than a length of the vane A, the lengths of the vanes A are substantially identical to each other and the vanes A are disposed at an interval so as to follow paths which are substantially identical to each other during rotation of the classification rotor, the lengths of the vanes B are substantially identical to each other and the vanes B are disposed at an interval so as to follow paths which are substantially identical to each other during the rotation of the classification rotor, a number of the vanes A which are disposed between two adjacent vanes B is one to three.

Herein, that "the lengths of the vanes are substantially identical to each other" is not limited to the case where the lengths of the vanes are exactly identical to each other, and includes the case where the lengths of the vanes are identical to each other to such a degree that the effect of the present disclosure is not spoiled.

A portion of the vane B from an end portion on the side of the rotation center to a first elbow may be linear or curved, and is preferably linear, as shown in FIG. 1. In addition, a portion of the vane B from the first elbow to an end portion on the side of the outer circumference may be linear or curved, and is preferably liner, as shown in FIG. 1.

Figure 7:
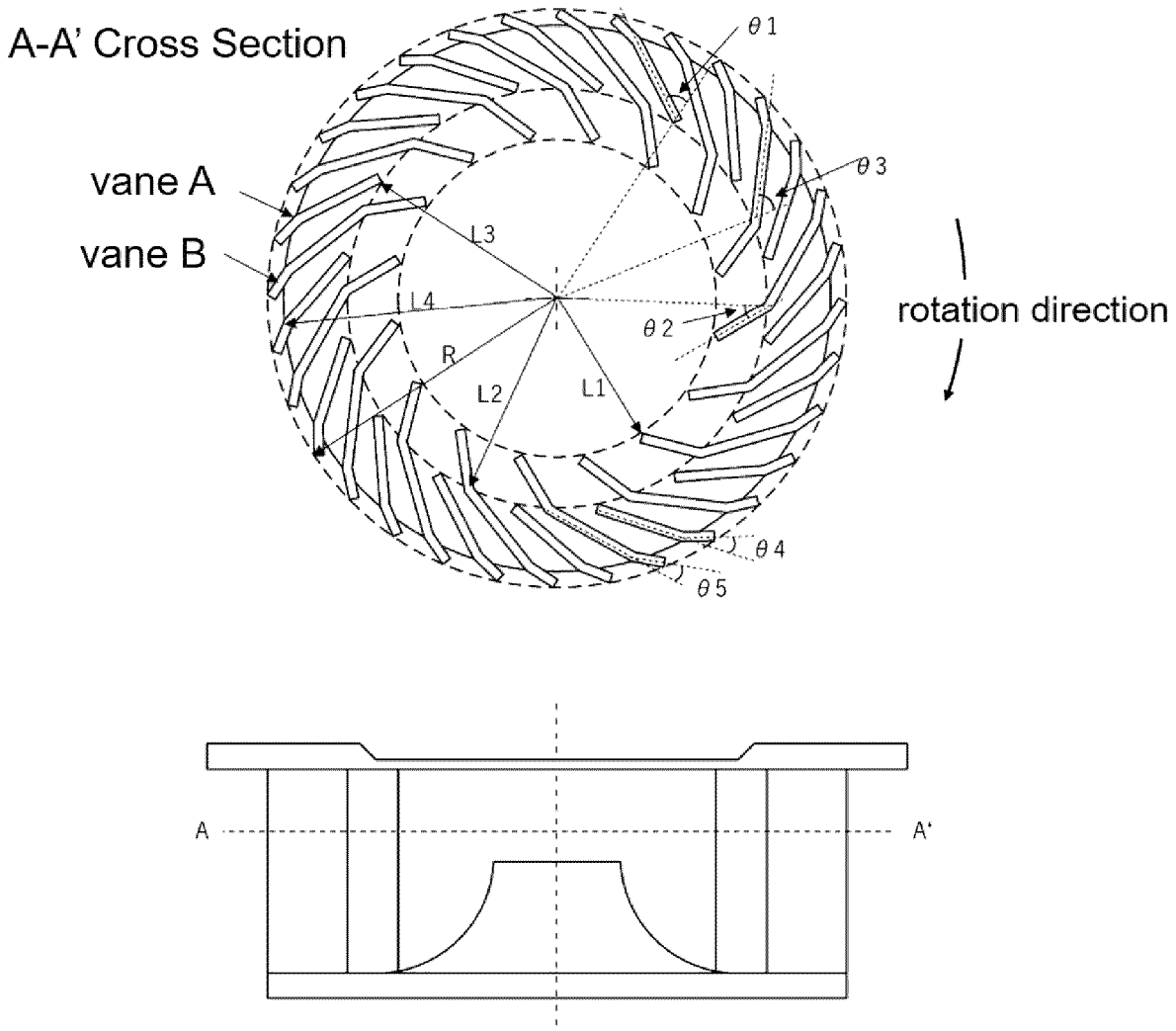
FIG. 7 is a schematic view of the classification rotor used in Example.

In the case where the vane B has a second elbow described later, a portion of the vane B from the first elbow to the second elbow may be linear or curved, and is preferably linear, as shown in FIG. 7. In addition, a portion of the vane B from the second elbow to the end portion on the side of the outer circumference may be linear or curved, and is preferably linear, as shown in FIG. 7.

A portion of the vane A from an end portion on the side of the rotation center to an end portion on the side of the outer circumference may be linear or curved, and is preferably linear, as shown in FIG. 1.

In the case where the vane A has an elbow described later, a portion of the vane A from the end portion on the side of the rotation center to the elbow may be linear or curved, and is preferably linear, as shown in FIG. 7. In addition, a portion of the vane A from the elbow to the end portion on the side of the outer circumference may be linear or curved, and is preferably linear, as shown in FIG. 7.

In the case where the above-described classification rotor is used, it is possible to provide the toner classification apparatus which reduces a load to a blower by suppressing pressure loss by the classification rotor, and displays an excellent yield while removing fine power adequately even in the case of toner having a small particle diameter. The present inventors make an assumption about factors therefor in the following manner.

The centrifugal force acting on a body is given by [weight of the body]×[radius of gyration]×[square of the angular velocity of the rotational motion]. Here, the radius of gyration of the particles to be classified is considered to be the distance between particles to be classified and the center of rotation of the classification rotor. As noted above, it is thought that, during the execution of the classification process, a vortex is generated between the vanes of the rapidly rotating classification rotor. The presence of this vortex causes the local occurrence of an air flow that is strongly drawn to the inner side, and this is presumed to cause particles that properly should not be removed to end up also being drawn in and removed. When the vortex is present as far as the inner side of the classification rotor, the particles to be classified are drawn in toward the inner side direction of the classification rotor, the centrifugal force then becomes smaller due to the smaller distance from the center of rotation, and return to the outer side of the classification rotor cannot take place and removal as particles having too small diameter ends up occurring as a result.

In a centrifugal air classifier such as the toner classification apparatus of the present disclosure, air for transporting powder approaches from the side of the outer circumference of the classification rotor, and flows to the side of the rotation center of the rotor and particles having too small diameter collection means which communicates with the side of the rotation center of the rotor after passing between the vanes of the classification rotor. At this point, it is considered that friction between the vane of the rotor and air and generation of a vortex flow between the vanes are factors for the pressure loss.

Figure 2A:
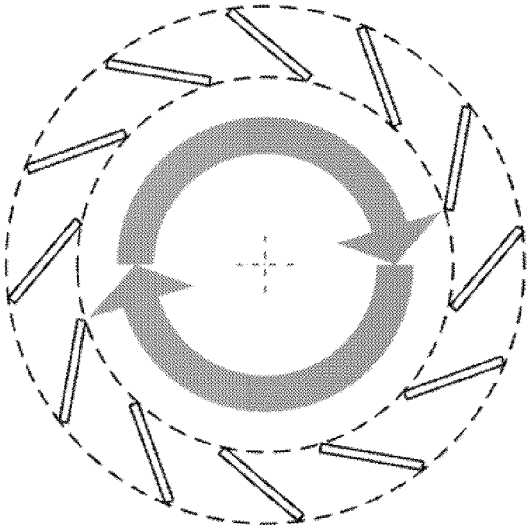
FIGS. 2A and 2B are explanatory views of a swirling flow inside a rotor.

It is considered that air having passed between the vanes of a conventional classification rotor becomes a swirling flow shown in FIG. 2A, and flows toward the particles having too small diameter collection means while being in contact with the end portion on the side of the rotation center of the vane of the classification rotor. The classification rotor of the present disclosure has, as shown in FIG. 1, a first vane group constituted by the vane A, and a second vane group constituted by the vane B having a length longer than that of the vane A.

Figure 2B:
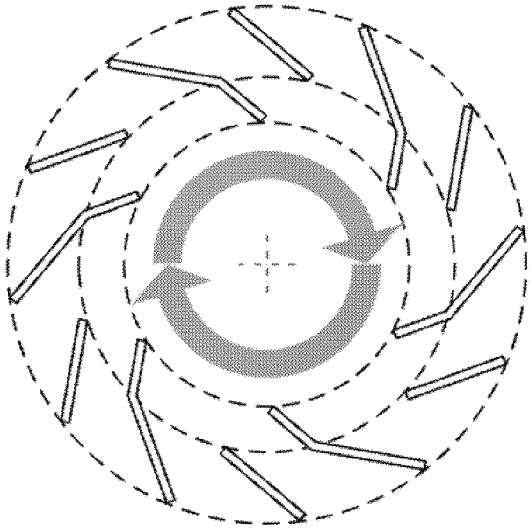

With the presence of the vane B which extends further to the rotation center direction of the classification rotor than the vane A, as shown in FIG. 2B, the swirling flow is regulated and its radius of gyration is reduced, and a relative speed between the end portion on the side of the rotation center of the vane of the classification rotor and the swirling flow is reduced. In addition, it is possible to prevent contact between the end portion on the side of the rotation center of the vane A and the swirling flow. With these, it is considered that the pressure loss can be reduced by a reduction in the friction between the side of the rotation center of the classification rotor and air.

The number of vanes A which are disposed between two adjacent vanes B is one to three. In the case where the number of vanes A disposed between two adjacent vanes B is four or more, the regulation of the swirling flow by the vane B is not adequate, and hence it is not possible to suppress the pressure loss. In addition, in the case where the number of vanes A is zero, contact between the end portion on the side of the rotation center of the vane B and the swirling flow is increased and a distance between the end portions on the side of the rotation center of the adjacent vanes B is reduced, whereby it becomes difficult for air to pass between the vanes, and hence it is not possible to suppress the pressure loss. The number of vanes A which are disposed between two adjacent vanes B does not have to be the same in all the places. It may be different in the range of 1 to 3 such as 2 in one place and 3 in another place.

Further, from the viewpoint of easily securing dynamic balance as a high-speed rotating member, the number of vanes A which are disposed between the vanes B is preferably one to three, more preferably one or two, and further preferably one.

In a cross section obtained when the classification rotor is cut in a direction perpendicular to the rotation axis of the classification rotor, the classification rotor is disposed such that a straight line which connects the rotation center of the classification rotor and the end portion on the side of the rotation center of the vane A and a portion on the vane A which is closer to the side of the outer circumference than the end portion on the side of the rotation center of the vane A form an angle θ1.

Herein, "a portion on the vane A which is closer to the side of the outer circumference than the end portion on the side of the rotation center of the vane A" denotes a portion where a straight line which connects the end portion on the side of the rotation center of the vane A and the end portion on the side of the outer circumference thereof and the vane A overlap each other in the case where the vane A does not have the elbow described later. In the case where the vane A has the elbow described later, it denotes a portion where a straight line which connects the end portion on the side of the rotation center of the vane A and the elbow of the vane A and the vane A overlap each other.

The vane B having a length longer than that of the vane A has the first elbow.

In addition, the vane A and the vane B are disposed such that a portion of a vane away from of the rotation center of the classification rotor is located on more upstream direction in a direction of rotation of the classification rotor than a portion of the vane closer to the rotation center of the classification rotor.

Further, a distance between the rotation center of the classification rotor and the end portion on the side of the outer circumference of the vane A and a distance between the rotation center of the classification rotor and the end portion on the side of the outer circumference of the vane B are substantially equal to each other.

Furthermore, a distance between the rotation center of the classification rotor and the end portion on the side of the rotation center of the vane A and a distance between the rotation center of the classification rotor and the first elbow of the vane B are substantially equal to each other.

In addition, the distance between the rotation center of the classification rotor and the end portion on the side of the rotation center of the vane A is longer than a distance between the rotation center of the classification rotor and the end portion on the side of the rotation center of the vane B.

Further, (ii) the classification rotor is disposed such that an angle θ3 formed by a straight line which connects the rotation center of the classification rotor and the first elbow of the vane B and a portion on the vane B which is closer to the side of the outer circumference than the first elbow of the vane B is substantially identical to the angle θ1.

Consequently, during the rotation of the classification rotor, a path followed by the side of the outer circumference of the vane B constituting the second vane group which is positioned on the side of the outer circumference of the first elbow and a path followed by the vane A constituting the first vane group are substantially identical to each other.

Herein, that "the distances are substantially equal to each other" is not limited to the case where the distances are exactly identical to each other, and includes the case where the distances are identical to each other to such a degree that the effect of the present disclosure is not spoiled. In addition, that "during the rotation of the classification rotor, paths followed the vane B and the vane A are substantially identical to each other" is not limited to the case where the paths are exactly identical to each other, and includes the case where the paths are identical to each other to such a degree that the effect of the present disclosure is not spoiled.

In addition, that "a portion on the vane B which is closer to the side of the outer circumference than the first elbow of the vane B" denotes a portion where a straight line which connects the first elbow of the vane B and the end portion on the side of the outer circumference of the vane B and the vane B overlap each other in the case where the vane B does not have the second elbow described later. In the case where the vane B has the second elbow described later, it denotes a portion where a straight line which connects the first elbow of the vane B and the second elbow thereof and the vane B overlap each other.

(i) θ1 satisfies 40° to 65°. When θ1 is in a range of 40° to 65°, it is possible to position a vortex generated during classification on the outside and, even in the case where a particle which should not be removed is drawn by the vortex, the particle can return to the outside of the classification rotor because a centrifugal force is not reduced, and hence it is considered that a yield is improved.

In the case where θ1 is less than 40°, the effect of positioning the vortex generated between the vanes of the above-described classification rotor which rotates at high speed on the outside is not adequate. In the case where θ1 is more than 65°, a distance between vicinities of the end portions on the side of the rotation center of the vanes of the classification rotor becomes excessively short, whereby it becomes difficult for particles having too small diameter which is to be removed from particles to be classified and air which transports the particles having too small diameter to pass between the vanes. Consequently, that serves as a factor for a reduction in classification performance and an increase in pressure loss.

θ1 is preferably 45° to 65°, and is more preferably 50° to 65°.

In addition, θ3 is preferably 45° to 65°, and is more preferably 50° to 65°.

(iv) When a radius of the classification rotor is represented by R and the distance between the rotation center of the classification rotor and the end portion on the side of the rotation center of the vane B is represented by L1, R and L1 satisfy $$0.35 \leq L1/R \leq 0.65.$$

In the case where L1/R is greater than 0.65, it is not possible to adequately reduce the radius of gyration of the swirling flow which comes into contact with the end portion on the side of the rotation center of the vane. In the case where L1/R is less than 0.35, wind flowing in from the outside is excessively concentrated on the side of the rotation center of the classification rotor, and hence the effect of suppressing the pressure loss is canceled.

L1/R is preferably from 0.40 to 0.55, and is more preferably from 0.40 to 0.50.

(v) When the distance between the rotation center of the classification rotor and the first elbow of the vane B is represented by L2, R, L1, and L2 satisfy $$0.35 \leq (L2-L1)/(R-L1) \leq 0.70.$$

(L2−L1)/(R−L1) is a value indicating a ratio of a length from the end portion on the side of the rotation center to the first elbow in the length of the vane B and, as the value is larger, the portion from the end portion on the side of the rotation center of the vane B to the first elbow is longer.

When (L2−L1)/(R−L1) is less than 0.35, the first elbow of the vane B is positioned closer to the side of the rotation center of the classification rotor. As a result, space between adjacent vanes is narrowed and the length from the end portion on the side of the rotation center of the vane B to the first elbow, which plays a role in reducing the radius of gyration of the swirling flow which comes into contact with the end portion on the side of the rotation center of the vane, is reduced, and hence it is not possible to reduce the pressure loss. When (L2−L1)/(R−L1) is greater than 0.70, the length from the first elbow of the vane B to the end portion on the side of the outer circumference is reduced, and hence the effect of positioning the vortex generated between the vanes during classification on the outside is not obtained, and the classification performance is reduced.

(L2−L1)/(R−L1) is preferably from 0.40 to 0.65, and is more preferably from 0.40 to 0.60.

(iii) An angle θ2)(° formed by the straight line which connects the rotation center of the classification rotor and the first elbow of the vane B and a straight line which connects the end portion on the side of the rotation center of the vane B and the first elbow of the vane B satisfies $$0° \leq \theta 2 \leq \theta 3 \times ½.$$

When the position of the first elbow of the vane B and L1 are fixed, the length from the end portion on the side of the rotation center of the vane B to the first elbow is minimized in the case where θ2=0° is satisfied, and the length from the end portion on the side of the rotation center to the first elbow is increased as θ2 is increased. It is considered that, in the case where θ2 is larger than θ3×½, a contact area between air and the vane B is increased and a distance between the portion closer to the side of the rotation center than the first elbow of the vane B and the end portion on the side of the rotation center of the vane adjacent to the vane B (i.e., the vane A) is short, and hence the effect of suppressing the pressure loss is not obtained.

The vane A preferably has the elbow, and preferably satisfies at least one selected from a group consisting of (vi) to (viii) shown below.

(vi) When it is assumed that the distance from the rotation center of the classification rotor to the end portion on the side of the rotation center of the vane A is L3 and a distance from the rotation center of the classification rotor to the elbow of the vane A is L4, $$0.65 \leq (L4-L3)/(R-L3) \leq 0.85$$

is preferably satisfied. When (L4−L3)/(R−L3) is 0.65 to 0.85, the suppression of the pressure loss by the classification rotor, ability to remove particles having too small diameter, and a yield are further improved. (L4−L3)/(R−L3) is more preferably 0.70 to 0.80.

(vii) An angle θ4 formed by a straight line which connects the end portion on the side of the rotation center of the vane A and the elbow of the vane A and a straight line which connects the elbow of the vane A and the end portion on the side of the outer circumference of the vane A is preferably 5° to 25°. When θ4 is 5° to 25°, the suppression of the pressure loss by the classification rotor, the ability to remove particles having too small diameter, and the yield are further improved. θ4 is more preferably 10° to 20°.

(viii) It is preferable that the vane B has the second elbow on the side of the outer circumference of the first elbow, the distance L4 between the rotation center of the classification rotor and the elbow of the vane A and a distance between the rotation center of the classification rotor and the second elbow of the vane B are substantially equal to each other, and an angle θ5 formed by a straight line which connects the first elbow of the vane B and the second elbow of the vane B and a straight line which connects the second elbow of the vane B and the end portion on the side of the outer circumference of the vane B is substantially equal to θ4. In the case where the requirements in (viii) are satisfied, the yield is improved by the effect of positioning the vortex generated between the vanes of the classification rotor which rotates at high speed further outside, and hence it is preferable to satisfy the above requirements.

R is not particularly limited and can be set appropriately according to the dimensions of the classification apparatus and the amount of a particle to be processed, and can be set to, e.g., 60 mm to 200 mm, 60 mm to 120 mm, or 100 mm to 200 mm.

L1 is not particularly limited and can be set appropriately according to the dimensions of the classification apparatus and the amount of the particle to be processed, and can be set to, e.g., 30 mm to 70 mm, or 40 mm to 120 mm.

L2 is not particularly limited and can be set appropriately according to the dimensions of the classification apparatus and the amount of the particle to be processed, and can be set to, e.g., 40 mm to 90 mm, or 60 mm to 170 mm.

L3 is not particularly limited and can be set appropriately according to the dimensions of the classification apparatus and the amount of the particle to be processed, and can be set to, e.g., 40 mm to 90 mm, or 60 mm to 170 mm.

L4 is not particularly limited and can be set appropriately according to the dimensions of the classification apparatus and the amount of the particle to be processed, and can be set to, e.g., 60 mm to 170 mm, or 100 mm to 200 mm.

Means for producing the classification rotor is not particularly limited, and examples thereof include a method in which individual parts are produced and assembled by welding, a method which uses a metal 3D printer which melts and solidifies metal powder by laser irradiation to output a structure, die casting in which a metal die is produced and melted metal such as an aluminum alloy is injected into the metal die with high pressure and molded, and evaporative pattern casting in which an evaporative pattern produced by a 3D printer is covered with a refractory material, the evaporative pattern is evaporated in a mold by application of heat from the outside, and metal is injected into a formed hollow portion.

In general, it is known that production which uses welding or die casting has an advantage that dimensional accuracy is high, but has a disadvantage that a production period is long, and the case where the metal 3D printer is used or evaporative pattern casing has an advantage that complicated shapes can be handled and a delivery time is short, but has a disadvantage that a production size is limited. The means for producing the classification rotor may be selected appropriately in consideration of the advantages and disadvantages of the individual production means, dimensions required of the classification rotor serving as a target, accuracy, and delivery times.

Figure 3:
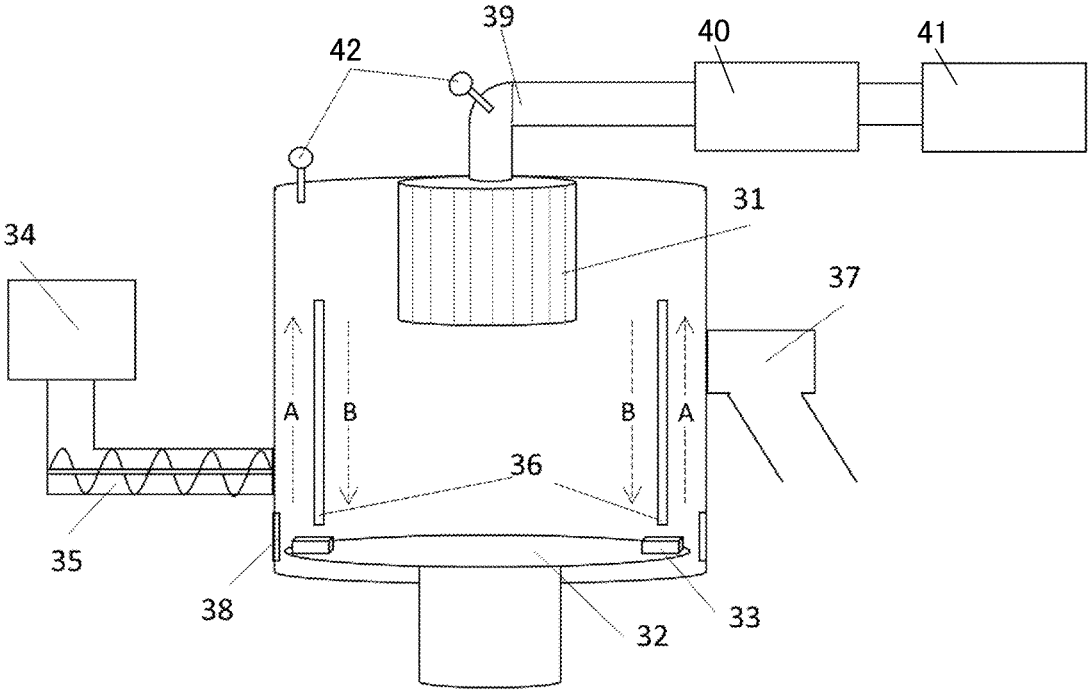
FIG. 3 is a schematic view of a toner classification apparatus used in Example.

The toner classification apparatus should have the classification rotor described above in order to remove the particles having too small diameter in the particles to be classified, but is not otherwise particularly limited, and the main unit of the toner classification apparatus may have, for example, supply means for supplying the particles to be classified, recovery means for the classified material post-classification processing, and so forth. As the particle diameter of the particles to be classified declines, the number of particles per unit weight increases and due to this the number of particle-to-particle contact points increases and aggregates are then more easily formed. From the standpoint of being able to proceed with the classification step while breaking down these aggregates, the toner classification apparatus preferably has, as shown in FIG. 3, a cylindrical body casing;

the aforementioned classification rotor 31;

cylindrical guide means 36 disposed in a state of overlapping at least a portion of the classification rotor;

an introduction port 34 for particles to be classified and supply means 35 for the particles to be classified that has the introduction port 34 for particles to be classified, these being formed in a side surface of the body casing in order to introduce the particles to be classified;

particles having too small diameter discharge port 39 and a classified particle take-off port 37, these being formed in a side surface of the body casing in order to discharge, from the body casing, classified particles from which the particles having too small diameter have been excluded; and a dispersion rotor 32 that is a rotating body attached within the body casing to the central rotational axle and that has a dispersion hammer (for example, a rectangular block) 33 on the surface of the classification rotor 31 side of the dispersion rotor 32.

The body casing and the guide means 36 are not limited to cylindrical shapes and may assume any shape.

Due to the presence of the guide means 36, an ascending air flow, directed toward the classification rotor 31, is produced in a first space A, and a descending air flow, directed to the side of the dispersion rotor 32, is produced in a second space B. It is thought that this enables the classification process to be carried out while the dispersion hammer 33 breaks up aggregates of the particles to be classified. As long as the dispersion hammer 33 can break up aggregates of the particles to be classified, it is not otherwise limited to a rectangular block and may assume any shape.

Moreover, from the standpoint of being able to improve the flowability by raising the average circularity of the toner, more preferably a liner 38 is disposed in a fixed manner at the circumference of the dispersion rotor 32 while maintaining a distance therefrom. The liner 38 is preferably provided with grooves in the surface that faces the dispersion rotor 32.

It is thought that when the particles to be classified undergo impact with, e.g., the rotating dispersion hammers and the surface of the liner facing the dispersion hammers, protruded portions on the particles to be classified are flattened and the circularity is raised as a result. When the efficiency of removing particles having too small diameter during classification is low, the circularity-improving effect on the particles may be reduced—due to the persistence of a condition in which a large number of particles to be classified are present within the casing—as compared to that when the efficiency of removing particles having too small diameter is high.

The total number of vanes (the sum of the number of vanes A and the number of vanes B) of the classification rotor is not particularly limited and can be set appropriately according to the dimensions of the classification rotor and the classification apparatus and the amount of the particle to be processed, and can be set to, e.g., twenty to eighty. The number of vanes A of the classification rotor is not particularly limited as well and can be set appropriately according to the dimensions of the classification rotor and the classification apparatus and the amount of the particle to be processed, and can be set to, e.g., ten to forty. The number of vanes B of the classification rotor is not particularly limited as well and can be set appropriately according to the dimensions of the classification rotor and the classification apparatus and the amount of the particle to be processed, and can be set to, e.g., ten to forty.

The height of the vane of the classification rotor is not particularly limited and can be set appropriately according to the dimensions of the classification rotor and the classification apparatus and the amount of the particle to be processed, and can be set to, e.g., 50 mm to 100 mm. In addition, the height of an opening of the classification rotor is not particularly limited and can be set appropriately according to the dimensions of the classification rotor and the classification apparatus and the amount of the particle to be processed, and can be set to, e.g., 50 mm to 100 mm.

An interval at the end portions on the side of the outer circumference of the vanes disposed in the classification rotor is not particularly limited, and can be set appropriately according to the dimensions of the classification rotor and the classification apparatus and the amount of the particle to be processed.

For example, an interval at the end portions on the side of the outer circumference of the vane A and the vane B disposed in the classification rotor is preferably 5.0 mm to 25.0 mm. When the interval is not more than 25.0 mm, a vortex of a current of air generated between the vane A and the vane B disposed in the classification rotor becomes less likely to be excessively large. In addition, when the interval is not less than 5.0 mm, it is possible to prevent time required for processing for narrowing the opening from being increased. The interval is more preferably 10.0 mm to 20.0 mm.

Dimensions such as the height and inner diameter of a main body casing in the classification apparatus are not particularly limited, and can be set appropriately according to the dimensions of the classification rotor and the amount of the particle to be processed. The height of the main body casing can be set to, e.g., 150 mm to 500 mm. In addition, it is possible to use the main body casing having a radius of the inner diameter of, e.g., 150 mm to 500 mm as the main body casing in the classification apparatus of the present disclosure.

The toner classification apparatus may be applied to the powder particles provided by known production methods, e.g., the melt-kneading/pulverization method, suspension polymerization method, emulsion aggregation method, dissolution suspension method, and so forth, but is advantageously used in particular in the melt-kneading/pulverization method in view of the ease of production of particles having too small diameter when smaller toner particle diameters are sought. A procedure for producing toner by the melt-kneading/pulverization method is described in the following, but there is no limitation to or by the following procedure.

Toner particle production method: First, in a starting material mixing step, at least a binder resin is weighed out in prescribed amounts as the toner starting material and is blended and mixed. The following, for example, may also be admixed as necessary: colorant, a release agent that suppresses the occurrence of hot offset when the toner is heated and fixed, a dispersing agent that disperses the release agent, a charge control agent, and so forth. The mixing apparatus can be exemplified by the double cone mixer, V-mixer, drum mixer, Super mixer, Henschel mixer, and Nauta mixer.

Then, in a melt-kneading step, the toner starting materials blended and mixed in the starting material mixing step are melt-kneaded and the resins are melted and the colorant and so forth are dispersed therein. For example, a batch kneader, e.g., a pressure kneader, Banbury mixer, and so forth, or a continuous kneader can be used in this melt-kneading step. Single-screw and twin-screw extruders have become the main stream in recent years because they offer the advantages of, e.g., enabling continuous production, and, for example, a Model KTK twin-screw extruder from Kobe Steel, Ltd., a Model TEM twin-screw extruder from Toshiba Machine Co., Ltd., a twin-screw extruder from KCK, a Co-Kneader from Buss AG, and so forth are commonly used.

After melt-kneading, the melt-kneaded material provided by melting-kneading the toner starting materials is rolled out using, for example, a two-roll mill, and cooled in a cooling step of cooling by, for example, water cooling.

The cooled melt-kneaded material provided by the cooling step is then pulverized to a desired particle diameter in a pulverization step. A coarse pulverization with, e.g., a crusher, hammer mill, feather mill, and so forth, is first carried out in the pulverization step. A pulverized material is then obtained by carrying out a fine pulverization using a mechanical pulverizer, e.g., Inomizer (Hosokawa Micron Corporation), Kryptron (Kawasaki Heavy Industries, Ltd.), Super Rotor (Nisshin Engineering Inc.), Turbo Mill (Turbo Kogyo Co., Ltd.), and so forth. Such a stagewise pulverization is performed in the pulverization step to the prescribed toner particle size.

Using the pulverized material provided by the pulverization step as the particles to be classified, a toner particle is obtained by carrying out a classification process (classification step), using the toner classification apparatus, on the particles to be classified.

The obtained toner particle may be used as such as toner, but, in order to provide functionalities required of toner, may be made into toner optionally by the addition of inorganic fine particles, e.g., silica, to the toner particle, followed by, e.g., the execution of a thermal spheronizing treatment.

In order to support an improved toner transferability, the average circularity of the toner is preferably at least 0.955 and is more preferably at least 0.960. The average circularity is preferably not more than 0.990 based on a consideration of preventing poor cleaning.

In addition, the weight-average particle diameter of the toner is preferably a small particle diameter from the standpoint of increasing the image quality of the image formed by the toner, and specifically from 3.50 μm to 6.00 μm is preferred and from 3.50 μm to 5.00 μm is more preferred. While small weight-average particle diameters are preferred for the toner, values of at least 3.50 μm largely prevent this parameter from contributing to image defects due to escape past the cleaning blade.

The number % of 3.0 μm or less in the toner is preferably not more than 20.0 number %, more preferably not more than 15.0 number %, and still more preferably not more than 10.0 number %.

Toner starting materials: The starting materials are described in the following for a toner that contains at least a binder resin.

Binder resin: Common resins can be used for the binder resin, for example, polyester resins, styrene-acrylic acid copolymers, polyolefin resins, vinyl resins, fluororesins, phenolic resins, silicone resins, and epoxy resins. Among the preceding, amorphous polyester resins are preferred from the standpoint of providing a good low-temperature fixability. The combination of a low molecular weight polyester resin with a high molecular weight polyester resin may be used based on a consideration of the coexistence of the low-temperature fixability with the hot offset resistance.

Viewed from the standpoint of the blocking resistance during storage and obtaining additional improvements in the low-temperature fixability, a crystalline polyester resin may also be used as a plasticizer.

Colorant: The toner starting materials can include a colorant. The following are examples of colorants that can be included in the toner starting materials. A single colorant may be used by itself or at least two thereof may be used in combination.

The colorant can be exemplified by known organic pigments and oil-based dyes, carbon black, magnetic bodies, and so forth.

Cyan colorants can be exemplified by copper phthalocyanine compounds and derivatives thereof, anthraquinone compounds, and basic dye lake compounds.

Magenta colorants can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Yellow colorants can be exemplified by condensed azo compounds, isoindolinone compounds, anthraquinone compounds, azo-metal complexes, methine compounds, and allylamide compounds.

Black colorants can be exemplified by carbon black and magnetic bodies and by black colorants provided by color mixing using the aforementioned yellow colorants, magenta colorants, and cyan colorants to give a black color.

Release agent: A release agent may be used on an optional basis to suppress the appearance of hot offset when the toner is heated and fixed. This release agent can be generally exemplified by low molecular weight polyolefins, silicone waxes, fatty acid amides, ester waxes, carnauba wax, and hydrocarbon waxes.

The methods used to measure the various properties of the starting materials and toner are described in the following. Method for measuring the weight-average particle diameter (D4) of the toner: The weight-average particle diameter (D4)

of the toner is determined by carrying out the measurements in 25,000 channels for the number of effective measurement channels and performing analysis of the measurement data using a "Coulter Counter Multisizer 3" (registered trademark, Beckman Coulter, Inc.), a precision particle size distribution measurement instrument operating on the pore electrical resistance method and equipped with a 100 μm aperture tube, and using the accompanying dedicated software, i.e., "Beckman Coulter Multisizer 3 Version 3.51" (Beckman Coulter, Inc.) to set the measurement conditions and analyze the measurement data.

The aqueous electrolyte solution used for the measurements is prepared by dissolving special-grade sodium chloride in deionized water to provide a concentration of approximately 1 mass % and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1600 μA; the gain is set to 2; the electrolyte solution is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250 mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the analysis software.

(2) Approximately 30 mL of the aqueous electrolyte solution is introduced into a 100 mL flatbottom glass beaker, and to this is added as dispersing agent approximately 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) A prescribed amount of deionized water is introduced into the water tank of an "Ultrasonic Dispersion System Tetora 150" (Nikkaki Bios Co., Ltd.), an ultrasound disperser having an electrical output of 120 W and equipped with two oscillators (oscillation frequency=50 kHz) disposed such that the phases are displaced by 180°, and approximately 2 mL of Contaminon N is added to the water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

Method for measuring the number % of 3.0 μm or less in the toner: When set to graph/number % with the dedicated software in step (7) in the method for measuring the weight-average particle diameter (D4) of the toner, the cumulative value for the number % in the particle diameter region of 3.0 μm or less is the number % of 3.0 μm or less.

Method for measuring the average circularity: The average circularity of the toner is measured using an "FPIA-3000" (Sysmex Corporation), a flow particle image analyzer, and using the measurement and analysis conditions from the calibration process.

The specific measurement procedure is as follows. First, approximately 20 mL of deionized water—from which, e.g., solid impurities have been removed in advance—is introduced into a glass vessel. To this is added as dispersing agent approximately 0.2 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.). Approximately 0.02 g of the measurement sample is added and a dispersion treatment is carried out for 2 minutes using an ultrasound disperser to provide a dispersion to be used for the measurement. Cooling is carried out as appropriate during this process in order to have the temperature of the dispersion be from 10° C. to 40° C. Using a benchtop ultrasound cleaner/disperser that has an oscillation frequency of 50 kHz and an electrical output of 150 W ("VS-150" (Velvo-Clear Co., Ltd.)) as the ultrasound disperser, a prescribed amount of deionized water is introduced into the water tank and approximately 2 mL of Contaminon N is added to the water tank.

The previously cited flow particle image analyzer fitted with an objective lens (10×) was used for the measurement, and "PSE-900A" (Sysmex Corporation) particle sheath was used for the sheath solution. The dispersion adjusted according to the procedure described above is introduced into the flow particle image analyzer and 3,000 toner particles are measured according to total count mode in HPF measurement mode. The average circularity of the toner particle is determined with the binarization threshold value during particle analysis set at 85% and the analyzed particle diameter limited to a circle-equivalent diameter of from 1.985 μm to less than 39.69 μm.

For this measurement, automatic focal point adjustment is performed prior to the start of the measurement using reference latex particles (a dilution with deionized water of "RESEARCH AND TEST PARTICLES Latex Microsphere Suspensions 5200A", Duke Scientific Corporation). After this, focal point adjustment is preferably performed every two hours after the start of measurement.

In the examples in the present application, the flow particle image analyzer used had been calibrated by the Sysmex Corporation and had been issued a calibration certificate by the Sysmex Corporation. The measurements were carried out using the measurement and analysis conditions when the calibration certification was received, with the exception that the analyzed particle diameter was limited to a circle-equivalent diameter of from 1.985 μm to less than 39.69 μm.

EXAMPLES

The present disclosure is described in additional detail in the following using examples and comparative examples, but these do not limit the embodiments according to the present disclosure. Unless specifically indicated otherwise, the number of parts given in the following in the examples and comparative examples are on a mass basis in all instances.

Binder Resin Production Example polyoxypropylene(2.2)-2,2-bis(4-hydroxyphenyl)propane: 72.0 parts (100 mol % with reference to the total number of moles of polyhydric alcohol)

terephthalic acid: 28.0 parts (96 mol % with reference to the total number of moles of polybasic carboxylic acid)

tin 2-ethylhexanoate (esterification catalyst): 0.5 parts

These materials were metered into a reactor equipped with a condenser, stirrer, nitrogen introduction line, and thermocouple. The interior of the flask was then substituted with nitrogen gas, the temperature was subsequently gradually raised while stirring, and a reaction was run for 8 hours while stirring at a temperature of 220° C. The pressure in the reactor was then reduced to 8.3 kPa, holding was carried out for 1 hour, cooling to 180° C. was thereafter implemented, and return to atmospheric pressure was carried out.

trimellitic anhydride: 1.3 parts (4 mol % with reference to the total number of moles of polybasic carboxylic acid)

tert-butylcatechol (polymerization inhibitor): 0.1 parts

These materials were subsequently added, the pressure in the reactor was dropped to 8.3 kPa, and a reaction was run for 1 hour while maintaining a temperature of 180° C. to obtain a binder resin (amorphous polyester resin). The softening point of the resulting binder resin, as measured in accordance with ASTM D 36-86, was 110° C.

Example of Production of Pulverized Particles for Use as Toner (Particles to be Classified)

binder resin 90 parts

Fischer-Tropsch wax (hydrocarbon wax, melting point=90° C.) 5 parts

C.I. Pigment Blue 15:3 5 parts

These materials were mixed using a Henschel mixer (Model FM-75, Mitsui Mining Co., Ltd.) at a rotation rate of 20 $s^{-1}$ and a rotation time of 5 minutes, and were then kneaded with a twin-screw kneader (Model PCM-30, Ikegai Corporation). The barrel temperature during kneading was set so as to provide an outlet temperature for the kneadate of 120° C. The outlet temperature of the kneadate was directly measured using an HA-200E handheld thermometer from Anritsu Meter Co., Ltd. The resulting kneadate was cooled and coarsely pulverized using a hammer mill to a volume-average particle diameter of not greater than 100 μm to provide a coarsely pulverized material.

A finely pulverized material was obtained by subjecting this coarsely pulverized material to pulverization using a mechanical pulverizer (Turbo Mill T250-CRS, rotor configuration: RS type, from Turbo Kogyo Co., Ltd.) and conditions of a rotor rotation rate of 11,000 rpm and a pulverization feed of 10 kg/h. The pulverized particles for use as toner (particles to be classified) were obtained by subjecting this finely pulverized material to additional pulverization using conditions of a rotor rotation rate of 12,000 rpm and a pulverization feed of 10 kg/h. The particles to be classified had a weight-average particle diameter of 4.62 μm, a number % of 3.0 μm or less of 39.6%, and an average circularity of 0.951.

Toner Classification Apparatus

The toner classification apparatus shown in FIG. 3 was used for the structure of the toner classification apparatus. This toner classification apparatus is constituted of the following:

- a cylindrical body casing;
- a disk-shaped dispersion rotor 32 that rotates at high speed and is a rotating body attached in the body casing to a central rotational axle, and that has a plurality of dispersion hammers 33 on the surface of the rotating body on the classification rotor side;
- a liner 38 that is disposed at the circumference of the dispersion rotor 32 while maintaining a distance therefrom;
- a classification rotor 31, which is means for the classification of particles to be classified;
- particles having too small diameter discharge port 39 for the discharge and removal of particles of not more than a prescribed particle diameter and selected by the classification rotor 31;
- a cooling wind introduction port (not shown) for the introduction of a cooling wind from below the dispersion rotor;
- an introduction port 34 for the particles to be classified and supply means 35 for the particles to be classified that has the introduction port 34 for the particles to be classified, for the introduction of the particles to be classified into the interior of the body casing;
- a classified particle take-off port 37 for discharging the classified particles after the classification process; and
- cylindrical guide means 36 disposed in a state of overlapping at least a portion of the classification rotor 31.

The guide means 36 partitions the space of the body casing in the toner classification apparatus into a space A, where an air current is produced in a direction that introduces the particles to be processed to the classification rotor 31, and a space B, where an air current is produced in the direction that introduces the particles to be processed to between the dispersion rotor 32 and the liner 38.

The particles having too small diameter discharge port 39 communicates with the particles having too small diameter collection means (cyclone) 40 for collecting discharged particles having too small diameter, and is connected to the blower 41 which communicates with the particles having too small diameter collection means 40. By using the blower 41, it is possible to generate a current of air which moves from the outside of the classification rotor 31 to the inside. In addition, the static pressure meters 42 for measuring a pressure inside the main body casing (classification apparatus inlet-side static pressure) and a pressure in a particles having too small diameter discharge port portion (classification apparatus outlet-side static pressure) are installed.

Under conditions where only the shape of the classification rotor differs and same classification conditions such as a blower air volume and the RPM of the rotor are used, in the case where a difference in static pressure before and after the classification apparatus is small, it can be considered that the pressure loss unique to the classification rotor is low. In the case where the pressure loss by the classification apparatus is small, that is preferable from the viewpoint of being able to suppress a load to the blower when the air volume required for classification is output to a low level.

Figure 4:
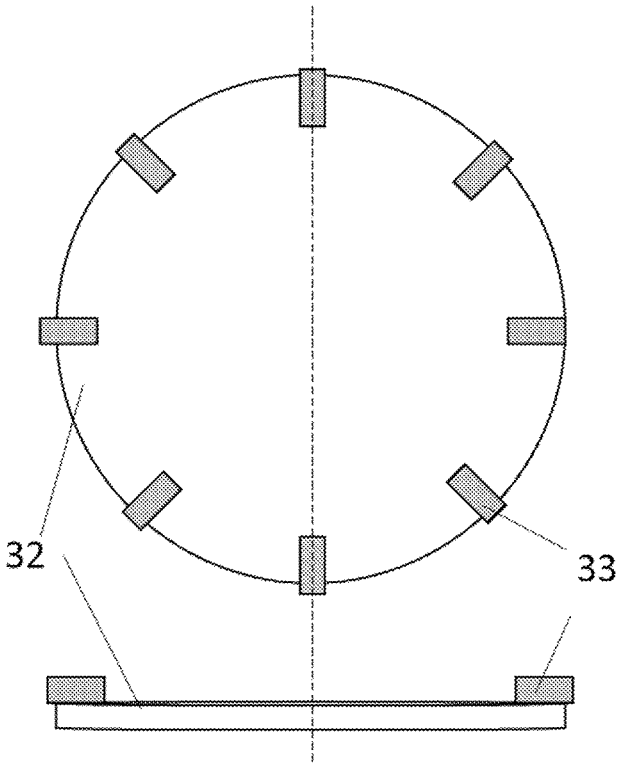
FIG. 4 is a schematic view of a dispersion rotor used in Example.

The height of the space in the body casing was 300 mm and the internal diameter was 300 mm. The outer diameter of the dispersion rotor was 285 mm, eight dispersion hammers were attached on the dispersion rotor as shown in FIG. 4, and the length/width/height of each dispersion hammer was 30 mm/20 mm/20 mm.

Figure 5:
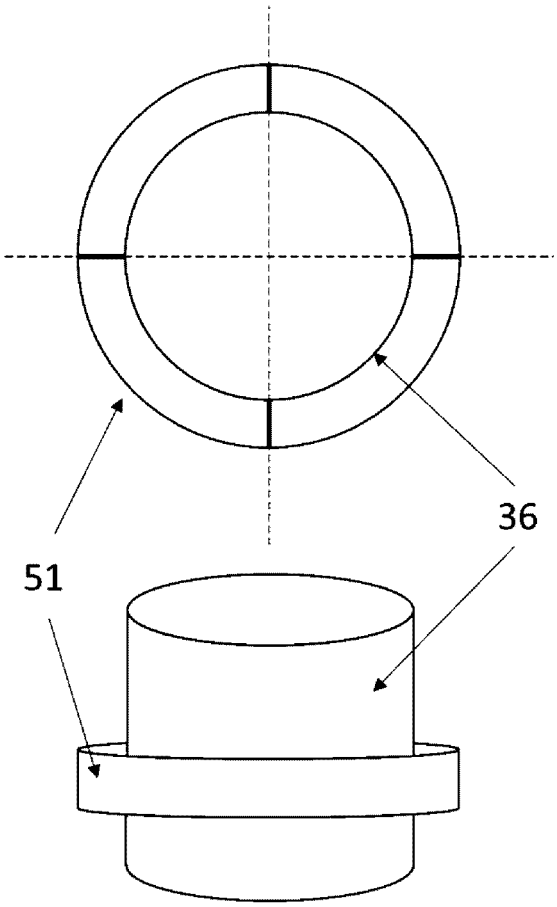
FIG. 5 is a schematic view of guide means used in Example.

As shown in FIG. 5, the cylindrical guide means was connected to a guide means support member 51 and could be installed at any position by connecting the guide means support member to the body casing using, e.g., screws. The diameter of the guide means was 250 mm and its height was 210 mm, and the distance between the upper end of the guide means and the upper end of the casing was 40 mm.

Liners

Figure 6:
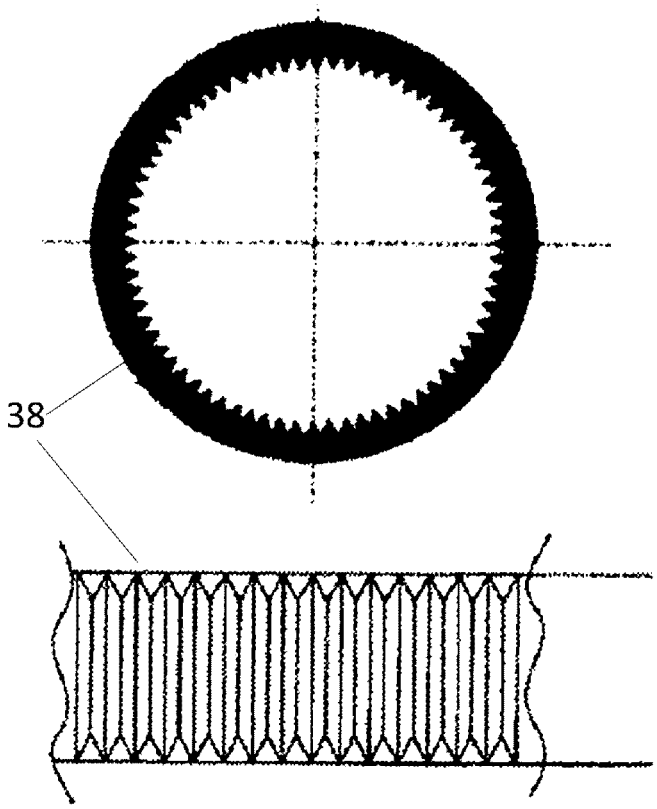
FIG. 6 is a schematic view of a liner used in Example.

Liner 1 as listed in Table 2 below had a plurality of protruded portions as shown in FIG. 6 and had a depressed portion formed between two protruded portions. This unevenness had a triangular shape, and the repeat distance from protruded portion to protruded portion was 3 mm, the depth of the depressed portions was 3.0 mm, and the height of the liner was 50 mm. Liner 2 as listed in Table 2 below lacked the surface unevenness of liner 1 and had a smooth surface.

Classification Rotors 1 to 20 (listed in Tables 1 and 2 below) Used in Examples A classification rotor 1 has a shape shown in FIG. 7. One vane A included in the first vane group was disposed between two adjacent vanes B included in the second vane group. The number of vanes of the first vane group (vane A) was sixteen, and the number of vanes of the second vane group (vane B) which were disposed was sixteen. R was 92 mm, L1 was 40 mm, L2 was 66 mm, L3 was 66 mm, L4 was 86 mm, θ1 was 60°, θ2 was 30°, θ3 was 60°, θ4 was 10°, θ5 was 10°, and the height of the opening of the classification rotor was 70 mm.

Each of classification rotors 2 and 5 has the shape shown in FIG. 7. With regard to the classification rotors 2 and 5, points different from the classification rotor 1 were shown in Table 1.

Figure 8:
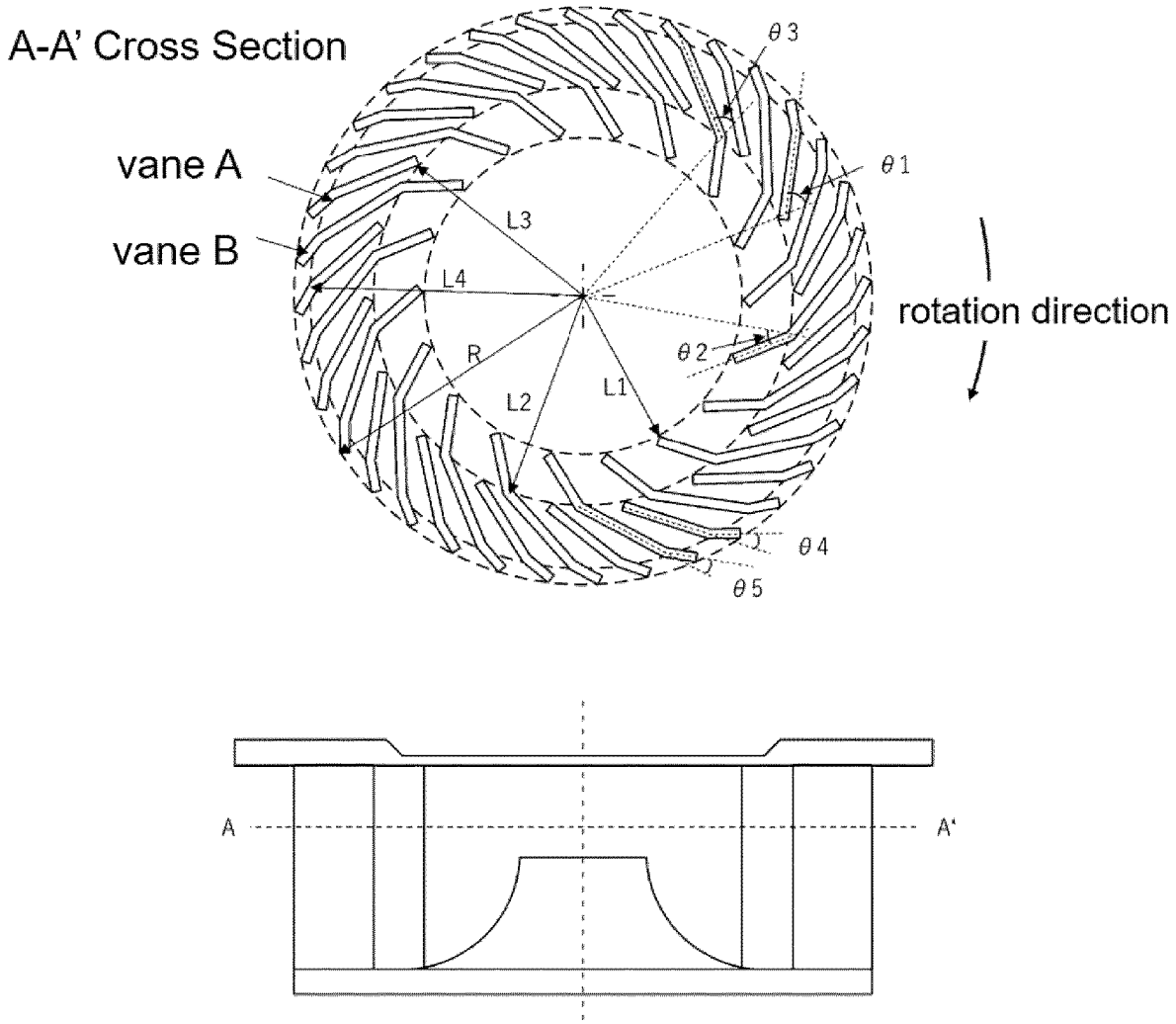
FIG. 8 is a schematic view of the classification rotor used in Example.

A classification rotor 3 has a shape shown in FIG. 8. One vane A included in the first vane group was disposed between two adjacent vanes B included in the second vane group. The number of vanes of the first vane group (vane A) was eighteen, and the number of vanes of the second vane group (vane B) which were disposed was eighteen.

Figure 9:
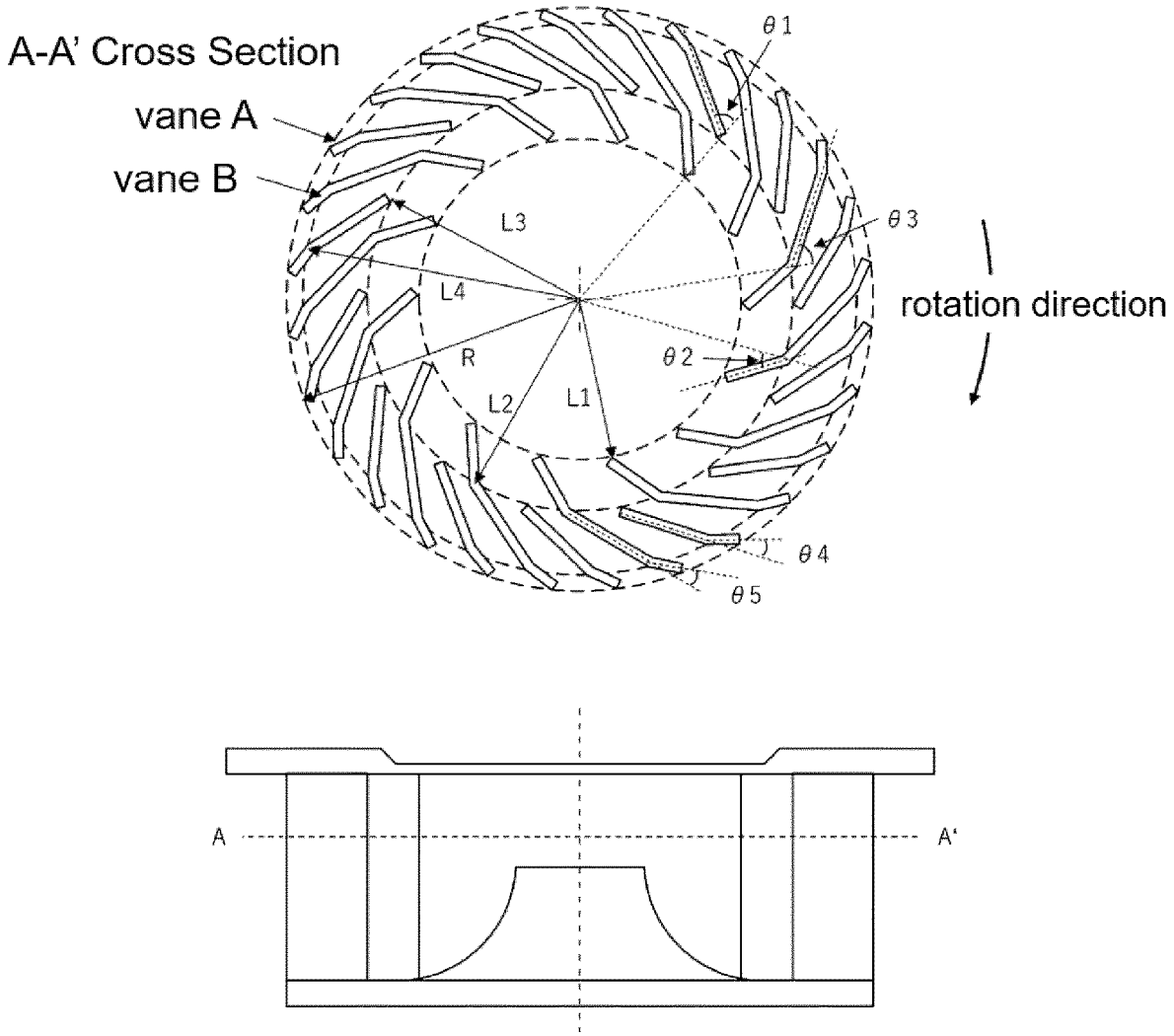
FIG. 9 is a schematic view of the classification rotor used in Example.

A classification rotor 4 has a shape shown in FIG. 9. One vane A included in the first vane group was disposed between two adjacent vanes B included in the second vane group. The number of vanes of the first vane group (vane A) was fourteen, and the number of vanes of the second vane group (vane B) which were disposed was fourteen.

A classification rotor 6 has a shape shown in FIG. 1. One vane A included in the first vane group was disposed between two adjacent vanes B included in the second vane group. The number of vanes of the first vane group (vane A) was sixteen, and the number of vanes of the second vane group (vane B) which were disposed was sixteen. R was 92 mm, L1 was 40 mm, L2 was 66 mm, L3 was 66 mm, θ1 was 60°, θ2 was 30°, θ3 was 60°, and the height of the opening of the classification rotor was 70 mm.

Each of classification rotors 7 and 11 to 20 has the shape shown in FIG. 1. With regard to the classification rotors 7 and 11 to 20, points different from the classification rotor 6 were shown in Table 1.

Figure 10:
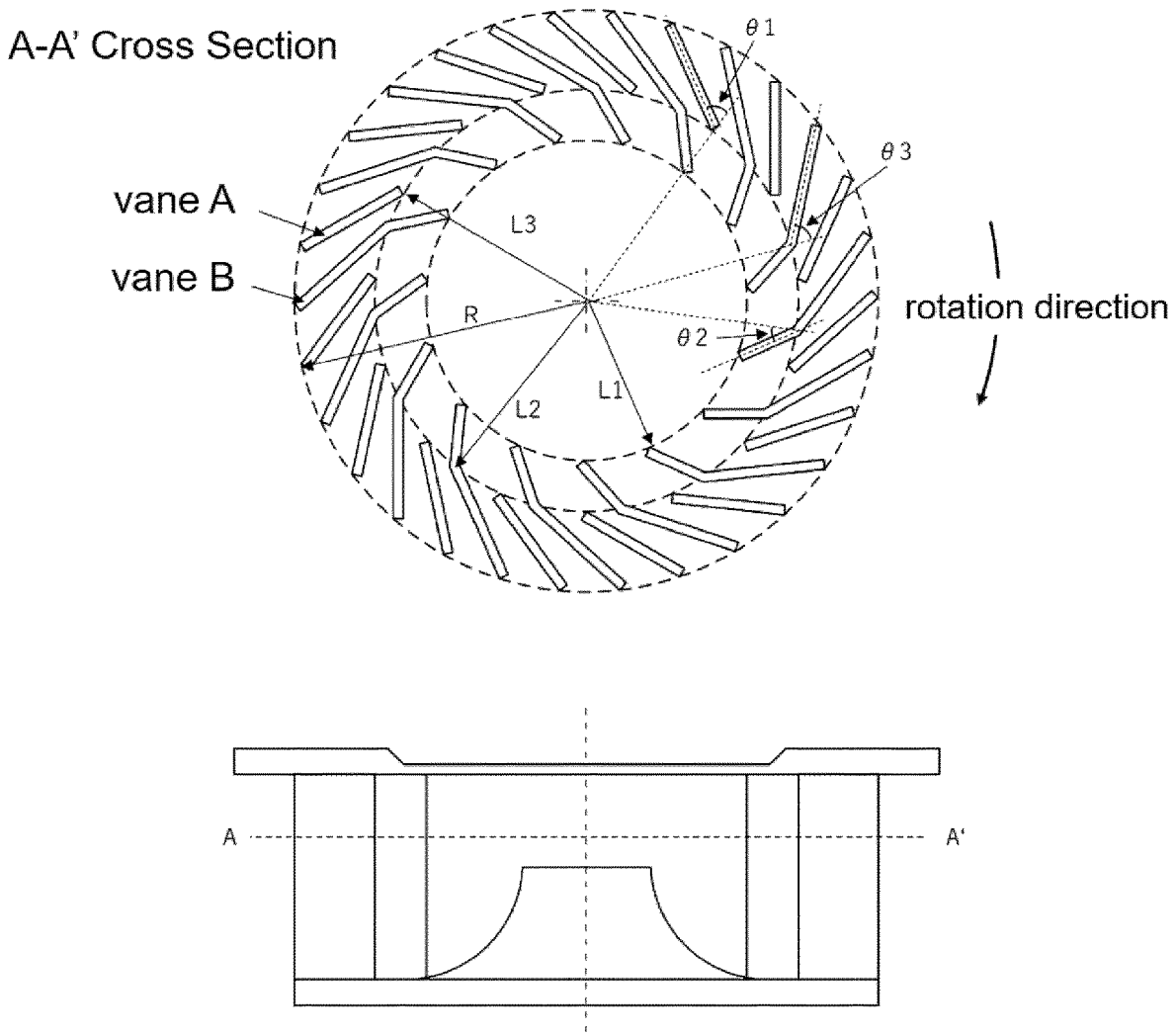
FIG. 10 is a schematic view of the classification rotor used in Example.

A classification rotor 8 has a shape shown in FIG. 10. One vane A included in the first vane group was disposed between two adjacent vanes B included in the second vane group. The number of vanes of the first vane group (vane A) was fifteen, and the number of vanes of the second vane group (vane B) which were disposed was fifteen. R was 92 mm, L1 was 40 mm, L2 was 66 mm, L3 was 66 mm, θ1 was 60°, θ2 was 30°, θ3 was 60°, and the height of the opening of the classification rotor was 70 mm.

Figure 11:
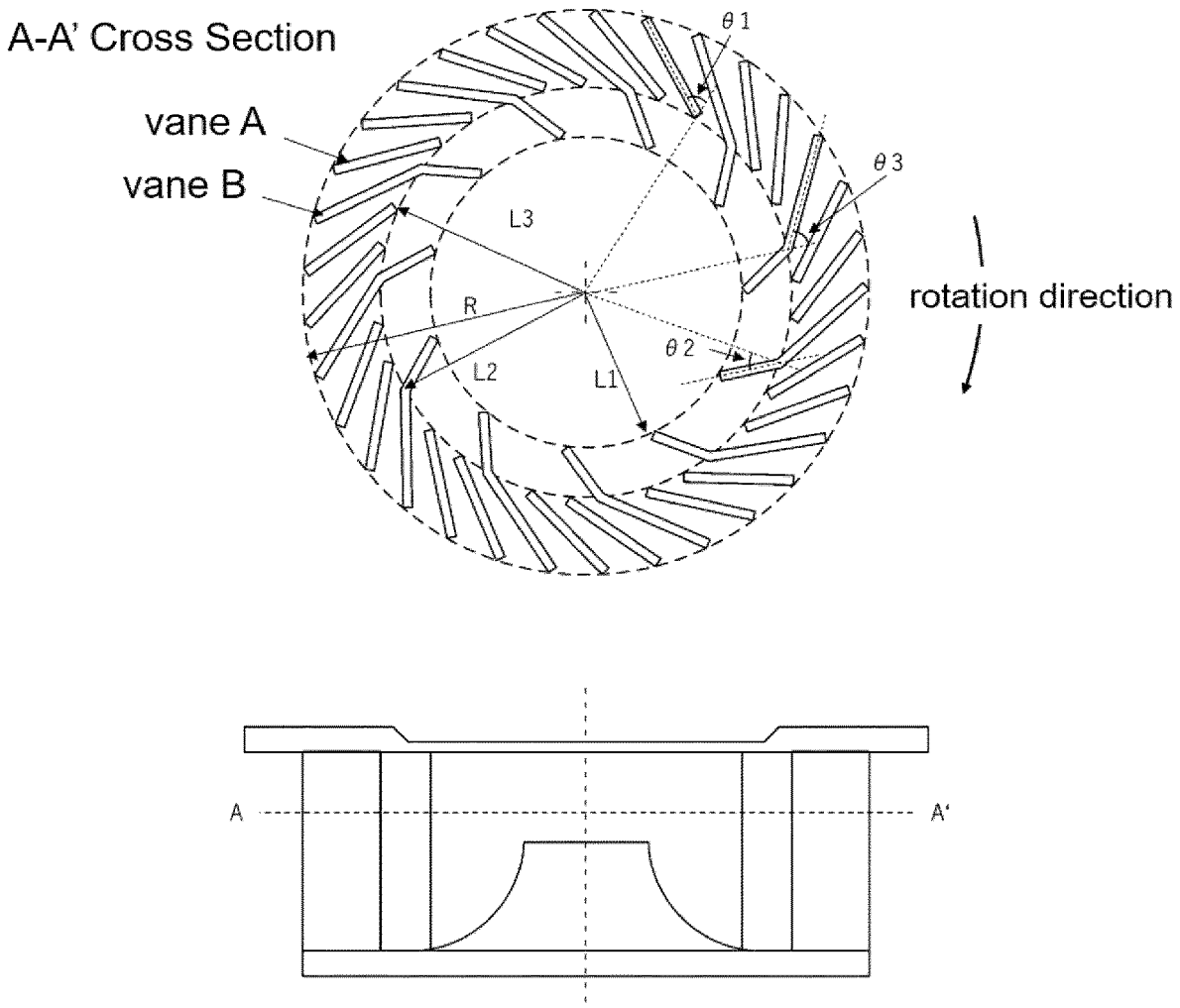
FIG. 11 is a schematic view of the classification rotor used in Example.

A classification rotor 9 has a shape shown in FIG. 11. Two vanes A included in the first vane group were disposed between two adjacent vanes B included in the second vane group. The number of vanes of the first vane group (vane A) was twenty-two, and the number of vanes of the second vane group (vane B) which were disposed was eleven. R was 92 mm, L1 was 40 mm, L2 was 66 mm, L3 was 66 mm, θ1 was 60°, θ2 was 30°, θ3 was 60°, and the height of the opening of the classification rotor was 70 mm.

Figure 12:
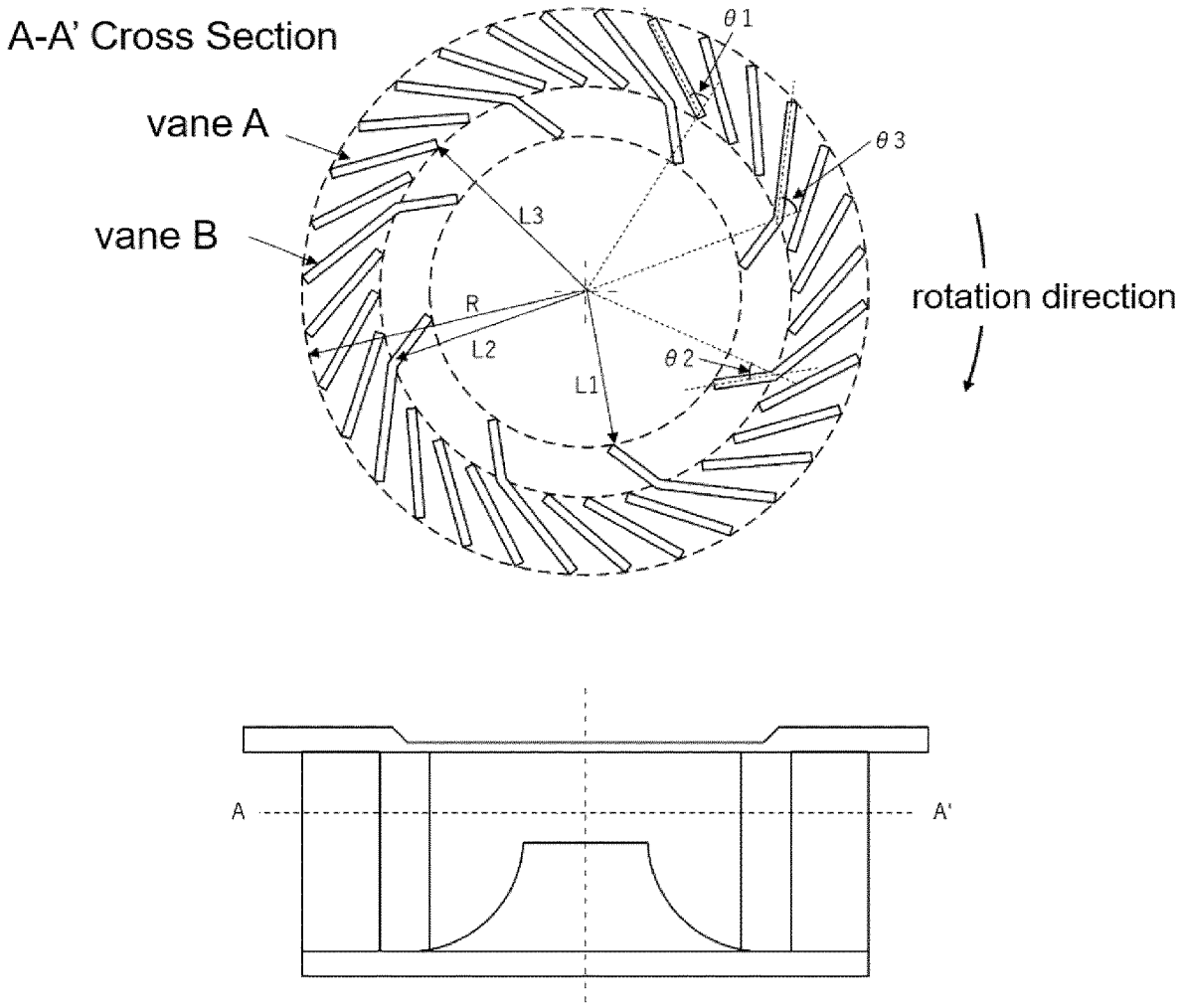
FIG. 12 is a schematic view of the classification rotor used in Example.

A classification rotor 10 has a shape shown in FIG. 12. Three vanes A included in the first vane group were disposed between two adjacent vanes B included in the second vane group. The number of vanes of the first vane group (vane A) was twenty-four, and the number of vanes of the second vane group (vane B) which were disposed was eight. R was 92 mm, L1 was 40 mm, L2 was 66 mm, L3 was 66 mm, θ1 was 60°, θ2 was 30°, θ3 was 60°, and the height of the opening of the classification rotor was 70 mm.

Figure 13:
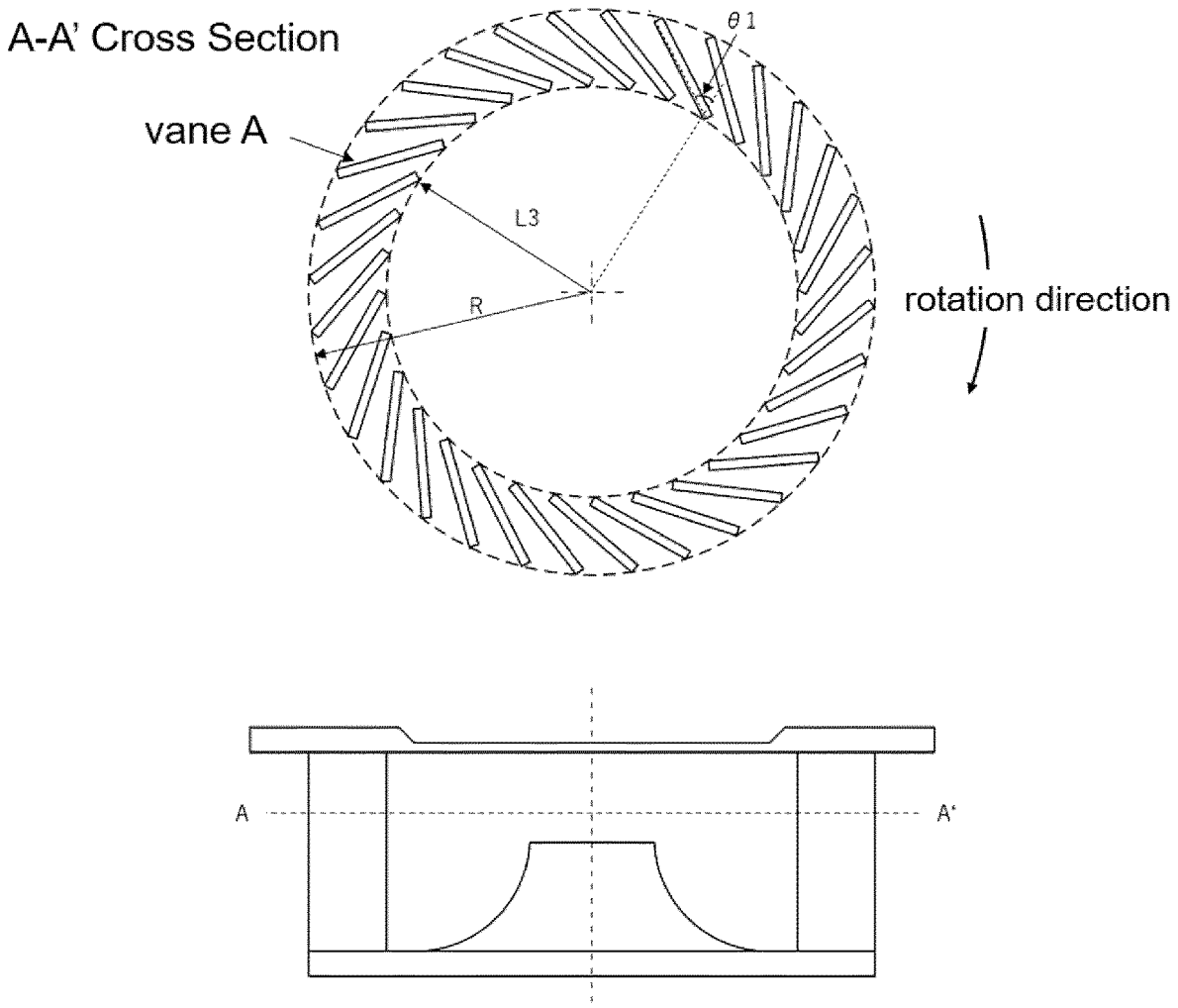
FIG. 13 is a schematic view of the classification rotor used in Comparative Example.

Comparative Rotors 1 to 10 (listed in Tables 1 and 2 below) Used in Comparative Examples A comparative rotor 1 has a shape shown in FIG. 13. R was 92 mm, L3 was 66 mm, θ1 was 60°, and the height of the opening of the classification rotor was 70 mm.

Figure 14:
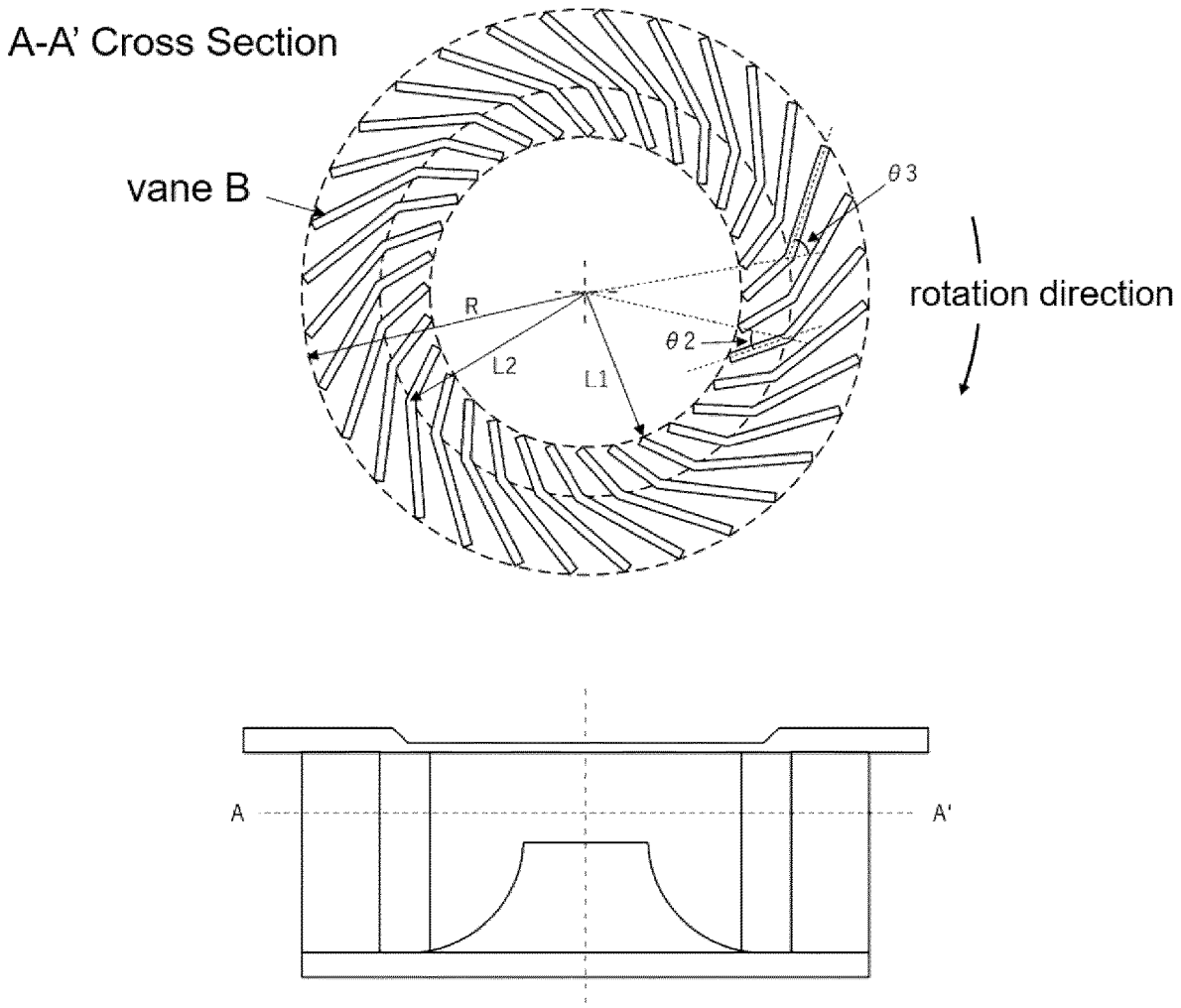
FIG. 14 is a schematic view of the classification rotor used in Comparative Example.

A comparative rotor 2 has a shape shown in FIG. 14. R was 92 mm, L1 was 40 mm, L2 was 66 mm, θ2 was 30°, θ3 was 60°, and the height of the opening of the classification rotor was 70 mm.

Each of comparative rotors 3 to 9 has the shape shown in FIG. 1. With regard to the comparative rotors 3 to 9, points different from the classification rotor 6 were shown in Table 1.

Figure 15:
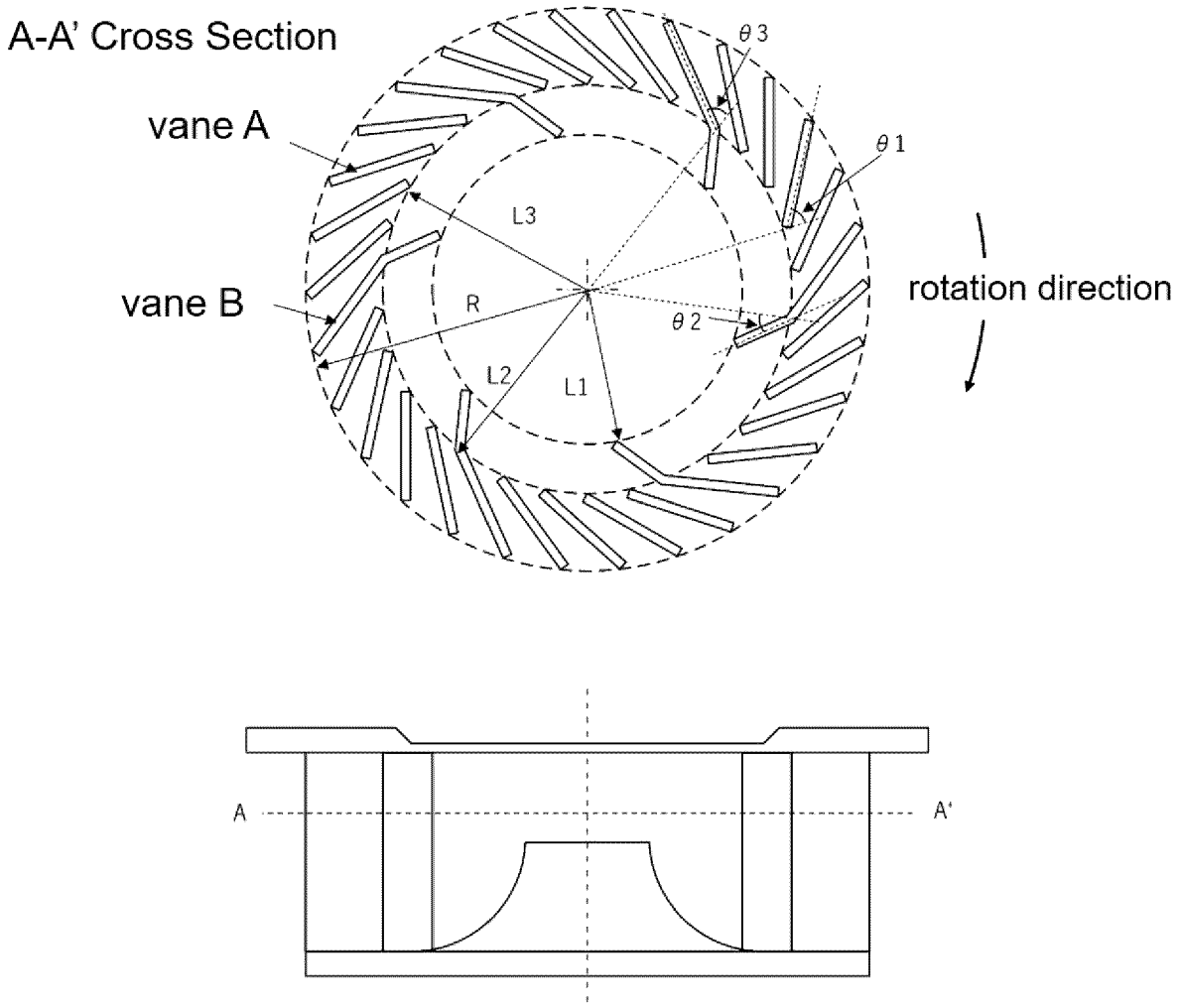
FIG. 15 is a schematic view of the classification rotor used in Comparative Example.

A comparative rotor 10 has a shape shown in FIG. 15. Four vanes A included in the first vane group were disposed between two adjacent vanes B included in the second vane group. The number of vanes of the first vane group (vane A) was twenty-four, and the number of vanes of the second vane group (vane B) which were disposed was six. R was 92 mm, L1 was 40 mm, L2 was 66 mm, L3 was 66 mm, θ1 was 60°, θ2 was 30°, θ3 was 60°, and the height of the opening of the classification rotor was 70 mm.

TABLE 1

| classification rotor | θ1 [°] | θ2 [°] | θ3 [°] | θ4 [°] | θ5 [°] | L1 [mm] | L2 [mm] | L3 [mm] | L4 [mm] | R [mm] | number of vanes A [number] | number of vanes B [number] |
|---|---|---|---|---|---|---|---|---|---|---|---|---|
| classification rotor 1 | 60 | 30 | 60 | 10 | 10 | 40 | 66 | 66 | 86 | 92 | 16 | 16 |
| classification rotor 2 | 60 | 30 | 60 | 20 | 20 | 40 | 66 | 66 | 86 | 92 | 16 | 16 |
| classification rotor 3 | 60 | 30 | 60 | 20 | 20 | 40 | 66 | 66 | 86 | 92 | 18 | 18 |
| classification rotor 4 | 60 | 30 | 60 | 20 | 20 | 40 | 66 | 66 | 86 | 92 | 14 | 14 |
| classification rotor 5 | 60 | 30 | 60 | 5 | 5 | 40 | 66 | 66 | 86 | 92 | 16 | 16 |
| classification rotor 6 | 60 | 30 | 60 | — | — | 40 | 66 | 66 | — | 92 | 16 | 16 |
| classification rotor 7 | 60 | 0 | 60 | — | — | 40 | 66 | 66 | — | 92 | 16 | 16 |
| classification rotor 8 | 60 | 30 | 60 | — | — | 40 | 66 | 66 | — | 92 | 15 | 15 |
| classification rotor 9 | 60 | 30 | 60 | — | — | 40 | 66 | 66 | — | 92 | 22 | 11 |
| classification rotor 10 | 60 | 30 | 60 | — | — | 40 | 66 | 66 | — | 92 | 24 | 8 |
| classification rotor 11 | 50 | 25 | 50 | — | — | 40 | 66 | 66 | — | 92 | 16 | 16 |
| classification rotor 12 | 40 | 20 | 40 | — | — | 40 | 66 | 66 | — | 92 | 16 | 16 |
| classification rotor 13 | 40 | 20 | 40 | — | — | 50 | 71 | 71 | — | 92 | 16 | 16 |
| classification rotor 14 | 40 | 20 | 40 | — | — | 38 | 65 | 65 | — | 92 | 16 | 16 |
| classification rotor 15 | 40 | 20 | 40 | — | — | 58 | 75 | 75 | — | 92 | 16 | 16 |
| classification rotor 16 | 40 | 20 | 40 | — | — | 34 | 63 | 63 | — | 92 | 16 | 16 |
| classification rotor 17 | 40 | 20 | 40 | — | — | 34 | 71 | 71 | — | 92 | 16 | 16 |
| classification rotor 18 | 40 | 20 | 40 | — | — | 34 | 59 | 59 | — | 92 | 16 | 16 |
| classification rotor 19 | 40 | 20 | 40 | — | — | 34 | 73 | 73 | — | 92 | 16 | 16 |
| classification rotor 20 | 40 | 20 | 40 | — | — | 34 | 56 | 56 | — | 92 | 16 | 16 |
| comparative rotor 1 | 60 | — | — | — | — | — | — | 66 | — | 92 | 32 | 0 |
| comparative rotor 2 | — | 30 | 60 | — | — | 40 | 66 | — | — | 92 | 0 | 32 |
| comparative rotor 3 | 75 | 0 | 75 | — | — | 40 | 66 | 66 | — | 92 | 16 | 16 |
| comparative rotor 4 | 35 | 0 | 35 | — | — | 40 | 66 | 66 | — | 92 | 16 | 16 |
| comparative rotor 5 | 60 | 35 | 60 | — | — | 40 | 66 | 66 | — | 92 | 16 | 16 |
| comparative rotor 6 | 60 | 30 | 60 | — | — | 28 | 60 | 60 | — | 92 | 16 | 16 |
| comparative rotor 7 | 60 | 30 | 60 | — | — | 62 | 77 | 77 | — | 92 | 16 | 16 |
| comparative rotor 8 | 60 | 30 | 60 | — | — | 40 | 78 | 78 | — | 92 | 16 | 16 |
| comparative rotor 9 | 60 | 30 | 60 | — | — | 40 | 56 | 56 | — | 92 | 16 | 16 |
| comparative rotor 10 | 60 | 30 | 60 | — | — | 40 | 66 | 66 | — | 92 | 24 | 6 |

| classification rotor | total number of vanes [number] | L1/R | (L2 − L1)/(R − L1) | (L4 − L3)/(R − L3) | interval at end portions on side of outer circumference of vane A and vane B[mm] | R − L2 |
|---|---|---|---|---|---|---|
| classification rotor 1 | 32 | 0.43 | 0.50 | 0.77 | 15.1 | 26 |
| classification rotor 2 | 32 | 0.43 | 0.50 | 0.77 | 15.1 | 26 |

TABLE 1-continued

| | | | | | | |
|---|---|---|---|---|---|---|
| classification rotor 3 | 36 | 0.43 | 0.50 | 0.77 | 13.1 | 26 |
| classification rotor 4 | 28 | 0.43 | 0.50 | 0.77 | 17.6 | 26 |
| classification rotor 5 | 32 | 0.43 | 0.50 | 0.77 | 15.1 | 26 |
| classification rotor 6 | 32 | 0.43 | 0.50 | — | 15.1 | 26 |
| classification rotor 7 | 32 | 0.43 | 0.50 | — | 15.1 | 26 |
| classification rotor 8 | 30 | 0.43 | 0.50 | — | 16.3 | 26 |
| classification rotor 9 | 33 | 0.43 | 0.50 | — | 14.5 | 26 |
| classification rotor 10 | 32 | 0.43 | 0.50 | — | 15.1 | 26 |
| classification rotor 11 | 32 | 0.43 | 0.50 | — | 15.1 | 26 |
| classification rotor 12 | 32 | 0.43 | 0.50 | — | 15.1 | 26 |
| classification rotor 13 | 32 | 0.54 | 0.50 | — | 15.1 | 21 |
| classification rotor 14 | 32 | 0.41 | 0.50 | — | 15.1 | 27 |
| classification rotor 15 | 32 | 0.63 | 0.50 | — | 15.1 | 17 |
| classification rotor 16 | 32 | 0.37 | 0.50 | — | 15.1 | 29 |
| classification rotor 17 | 32 | 0.37 | 0.64 | — | 15.1 | 21 |
| classification rotor 18 | 32 | 0.37 | 0.43 | — | 15.1 | 33 |
| classification rotor 19 | 32 | 0.37 | 0.67 | — | 15.1 | 19 |
| classification rotor 20 | 32 | 0.37 | 0.38 | — | 15.1 | 36 |
| comparative rotor 1 | 32 | — | — | — | 15.1 | 26 |
| comparative rotor 2 | 32 | 0.43 | 0.50 | — | 15.1 | 26 |
| comparative rotor 3 | 32 | 0.43 | 0.50 | — | 15.1 | 26 |
| comparative rotor 4 | 32 | 0.43 | 0.50 | — | 15.1 | 26 |
| comparative rotor 5 | 32 | 0.43 | 0.50 | — | 15.1 | 26 |
| comparative rotor 6 | 32 | 0.30 | 0.50 | — | 15.1 | 32 |
| comparative rotor 7 | 32 | 0.67 | 0.50 | — | 15.1 | 15 |
| comparative rotor 8 | 32 | 0.43 | 0.73 | — | 15.1 | 14 |
| comparative rotor 9 | 32 | 0.43 | 0.31 | — | 15.1 | 36 |
| comparative rotor 10 | 30 | 0.43 | 0.50 | — | 16.3 | 26 |

Examples 1 to 22, Comparative Examples 1 to 10 (Listed in Table 2 Below)

Classification was performed 60 cycles under conditions that the classification rotor 1 and a liner 1 were mounted to the toner classification apparatus, the RPM of the classification rotor was 9000 rpm, the RPM of the dispersion rotor was 5000 rpm, the blower air volume was 10.0 $m^3$/min, a classification cycle was 60 sec (classified particle loading time 10 sec, classification time 30 sec, post-classification classified particle collection time 20 sec), the toner pulverized particle was used as particles to be classified, and the loading amount of the particles to be classified per cycle was 200 g, and a toner 1 was thereby obtained. In addition, as shown in Table 2, by changing conditions, toners 2 to 22 and comparative toners 1 to 10 were obtained.

Further, the weight-average particle diameter D4, the number % of not more than 3.0 μm, and the average circularity of each toner were measured by the above-described measurement means. In addition, a classification yield was determined from the loading amount of the particles to be classified (200 g×60 cycles) and the mass of an obtained toner.

Furthermore, in each classification condition, an outlet-side static pressure of the classification rotor before the particles to be classified is loaded (during idle running) was subtracted from an inlet-side static pressure of the classification rotor, and a difference in static pressure before and after the classification rotor was calculated. At this point, a side closer to the blower, i.e., an outlet side in the classification rotor communicating with the blower had a static pressure which was more negative than that of an inlet side in the classification rotor (a side communicating with a classified particle loading port), and hence the difference in static pressure had a positive value.

Evaluation results were summarized in Table 2.

Evaluation: Evaluation Criterion of Yield

A: yield of not less than 70.0%

B: yield of not less than 60.0% and less than 70.0%

C: yield of not less than 50.0% and less than 60.0%

D: yield of not less than 45.0% and less than 50.0%

E: yield of less than 45.0%

Evaluation: Evaluation Criterion of Number % of Not More Than 3.0 μm

A: less than 10.0 number %

B: not less than 10.0 number % and less than 15.0 number %

C: not less than 15.0 number % and less than 20.0 number %

D: not less than 20.0 number % and less than 25.0 number %

E: not less than 25.0 number %

Evaluation: Evaluation Criterion of Difference in Static Pressure Before and After Classification Rotor A: less than 7.20 kPa B: not less than 7.20 kPa and less than 7.60 kPa C: not less than 7.60 kPa and less than 8.00 kPa D: not less than 8.00 kPa and less than 8.40 kPa E: not less than 8.40 kPa Overall Evaluation A: all items were ranked A (excellent)

B: at least one item which was the lowest item was ranked B (good)

C: at least one item which was the lowest item was ranked C

D: at least one item was ranked D (not permitted in the present disclosure)

E: at least one item was ranked E (not permitted in the present disclosure)

Reference Evaluation: Average Circularity

A: average circularity not less than 0.960

B: average circularity not less than 0.955 and less than 0.960

C: average circularity less than 0.955

TABLE 2

| | | classification condition | | evaluation | | | | | | | | | |
|---|---|---|---|---|---|---|---|---|---|---|---|---|---|
| | | classification | | yield | | D4 | number % of not more than 3.0 μm | | difference in static pressure | | overall | | average |
| | toner | rotor | liner | [%] | | [μm] | [number %] | | [kPa] | | evaluation | | circularity |
| Example 1 | toner 1 | classification rotor 1 | liner 1 | 74.2 | A | 4.90 | 6.6 | A | 7.08 | A | A | 0.962 | A |
| Example 2 | toner 2 | classification rotor 2 | liner 1 | 74.4 | A | 4.91 | 6.9 | A | 7.09 | A | A | 0.962 | A |
| Example 3 | toner 3 | classification rotor 3 | liner 1 | 74.3 | A | 4.92 | 6.3 | A | 7.08 | A | A | 0.962 | A |
| Example 4 | toner 4 | classification rotor 4 | liner 1 | 74.2 | A | 4.91 | 6.8 | A | 7.08 | A | A | 0.962 | A |
| Example 5 | toner 5 | classification rotor 5 | liner 1 | 71.1 | A | 4.91 | 8.8 | A | 7.04 | A | A | 0.963 | A |
| Example 6 | toner 6 | classification rotor 5 | liner 2 | 70.5 | A | 4.92 | 9.1 | A | 7.04 | A | A | 0.956 | B |
| Example 7 | toner 7 | classification rotor 6 | liner 1 | 66.8 | B | 4.93 | 11.1 | B | 7.10 | A | B | 0.962 | A |
| Example 8 | toner 8 | classification rotor 6 | liner 2 | 66.7 | B | 4.94 | 11.5 | B | 7.11 | A | B | 0.956 | B |
| Example 9 | toner 9 | classification rotor 7 | liner 2 | 66.1 | B | 4.94 | 11.2 | B | 7.11 | A | B | 0.957 | B |
| Example 10 | toner 10 | classification rotor 8 | liner 2 | 65.1 | B | 4.96 | 11.6 | B | 7.09 | A | B | 0.957 | B |
| Example 11 | toner 11 | classification rotor 9 | liner 2 | 66.1 | B | 4.94 | 11.5 | B | 7.11 | A | B | 0.957 | B |
| Example 12 | toner 12 | classification rotor 10 | liner 2 | 66.4 | B | 4.95 | 11.9 | B | 7.18 | A | B | 0.957 | B |
| Example 13 | toner 13 | classification rotor 11 | liner 2 | 62.3 | B | 4.95 | 13.3 | B | 7.06 | A | B | 0.957 | B |
| Example 14 | toner 14 | classification rotor 12 | liner 2 | 59.2 | C | 4.96 | 16.1 | C | 7.05 | A | C | 0.956 | B |
| Example 15 | toner 15 | classification rotor 13 | liner 2 | 58.8 | C | 4.95 | 15.5 | C | 7.15 | A | C | 0.956 | B |
| Example 16 | toner 16 | classification rotor 14 | liner 2 | 58.2 | C | 4.95 | 16.2 | C | 7.15 | A | C | 0.956 | B |
| Example 17 | toner 17 | classification rotor 15 | liner 2 | 58.1 | C | 4.95 | 16.1 | C | 7.41 | B | C | 0.956 | B |
| Example 18 | toner 18 | classification rotor 16 | liner 2 | 58.6 | C | 4.95 | 16.1 | C | 7.42 | B | C | 0.956 | B |
| Example 19 | toner 19 | classification rotor 17 | liner 2 | 58.5 | C | 4.95 | 16.3 | C | 7.42 | B | C | 0.956 | B |
| Example 20 | toner 20 | classification rotor 18 | liner 2 | 58.2 | C | 4.95 | 16.4 | C | 7.42 | B | C | 0.956 | B |
| Example 21 | toner 21 | classification rotor 19 | liner 2 | 52.1 | C | 4.97 | 18.4 | C | 7.51 | B | C | 0.956 | B |
| Example 22 | toner 22 | classification rotor 20 | liner 2 | 55.3 | C | 4.94 | 17.4 | C | 7.62 | C | C | 0.956 | B |
| Comparative Example 1 | comparative toner 1 | comparative rotor 1 | liner 2 | 66.1 | B | 4.93 | 12.3 | B | 8.51 | E | E | 0.957 | B |
| Comparative Example 2 | comparative toner 2 | comparative rotor 2 | liner 2 | 66.2 | B | 4.92 | 12.4 | B | 8.52 | E | E | 0.957 | B |
| Comparative Example 3 | comparative toner 3 | comparative rotor 3 | liner 2 | 74.2 | A | 4.77 | 28.2 | E | 8.11 | D | E | 0.953 | C |
| Comparative Example 4 | comparative toner 4 | comparative rotor 4 | liner 2 | 40.2 | E | 4.92 | 25.2 | E | 7.55 | B | E | 0.956 | B |
| Comparative Example 5 | comparative toner 5 | comparative rotor 5 | liner 2 | 65.2 | B | 4.93 | 12.3 | B | 8.12 | D | D | 0.956 | B |
| Comparative Example 6 | comparative toner 6 | comparative rotor 6 | liner 2 | 65.3 | B | 4.92 | 12.5 | B | 8.11 | D | D | 0.957 | B |
| Comparative Example 7 | comparative toner 7 | comparative rotor 7 | liner 2 | 65.4 | B | 4.95 | 11.8 | B | 8.13 | D | D | 0.957 | B |
| Comparative Example 8 | comparative toner 8 | comparative rotor 8 | liner 2 | 48.5 | D | 4.99 | 21.1 | D | 7.71 | C | D | 0.957 | B |
| Comparative Example 9 | comparative toner 9 | comparative rotor 9 | liner 2 | 66.3 | B | 4.88 | 12.3 | B | 8.12 | D | D | 0.957 | B |
| Comparative Example 10 | comparative toner 10 | comparative rotor 10 | liner 2 | 65.1 | B | 4.96 | 11.9 | B | 8.10 | D | D | 0.957 | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-136137, filed Aug. 24, 2021, which is hereby incorporated by reference herein in its entirety.

What is claimed is:

1. A toner classification apparatus comprising:

a classification rotor; wherein the classification rotor comprises a plurality of vanes which extend from a rotation center direction of the classification rotor to an outer circumference direction of the classification rotor, the plurality of vanes are disposed with prescribed gaps established between the vanes;

the gaps form an opening which faces a rotation center area of the classification rotor;

the plurality of vanes comprise a first vane group constituted by a vane A and a second vane group constituted by a vane B having a length longer than a length of the vane A, the lengths of the vanes A are substantially identical to each other and the vanes A are disposed at an interval so as to follow paths which are substantially identical to each other during rotation of the classification rotor, the lengths of the vanes B are substantially identical to each other and the vanes B are disposed at an interval so as to follow paths which are substantially identical to each other during the rotation of the classification rotor, a number of the vanes A which are disposed between two adjacent vanes B is one to three, the vane B has a first elbow, the vane A and the vane B are disposed such that a portion of a vane away from of the rotation center of the classification rotor is located on more upstream direction in a direction of rotation of the classification rotor than a portion of the vane closer to the rotation center of the classification rotor, a distance between the rotation center of the classification rotor and the end portion on the side of the outer circumference of the vane A and a distance between the rotation center of the classification rotor and the end portion on the side of the outer circumference of the vane B are substantially equal to each other, a distance between the rotation center of the classification rotor and the end portion on the side of the rotation center of the vane A and a distance between the rotation center of the classification rotor and the first elbow of the vane B are substantially equal to each other, the distance between the rotation center of the classification rotor and the end portion on the side of the rotation center of the vane A is more than a distance between the rotation center of the classification rotor and the end portion on the side of the rotation center of the vane B, and, in a cross section obtained when the classification rotor is cut in a direction perpendicular to a rotation axis of the classification rotor, (i) an angle θ1 (° ) formed by a straight line which connects the rotation center of the classification rotor and the end portion on the side of the rotation center of the vane A and a portion on the vane A which is closer to the side of the outer circumference than the end portion on the side of the rotation center of the vane A is 40 to 65°, (ii) an angle θ3 (° ) formed by a straight line which connects the rotation center of the classification rotor and the first elbow of the vane B and a portion on the vane B which is closer to the side of the outer circumference than the first elbow of the vane B is substantially identical to the angle θ1, (iii) an angle θ2 (° ) formed by the straight line which connects the rotation center of the classification rotor and the first elbow of the vane B and a straight line which connects the end portion on the side of the rotation center of the vane B and the first elbow of the vane B satisfies $$0° \leq \theta 2 \leq \theta 3 \times ½,$$

(iv) when a radius of the classification rotor is represented by R and the distance between the rotation center of the classification rotor and the end portion on the side of the rotation center of the vane B is represented by L1, the R and the L1 satisfy $$0.35 \leq L1/R \leq 0.65, \text{ and}$$

(v) when the distance between the rotation center of the classification rotor and the first elbow of the vane B is represented by L2, the R, the L1, and the L2 satisfy $$0.35 \leq (L2-L1)/(R-L1) \leq 0.70.$$

2. The toner classification apparatus according to claim 1, wherein the vane A has an elbow, and (vi) when the distance from the rotation center of the classification rotor to the end portion on the side of the rotation center of the vane A is represented by L3 and a distance from the rotation center of the classification rotor to the elbow of the vane A is represented by L4, $$0.65 \leq (L4-L3)/(R-L3) \leq 0.85 \text{ is satisfied.}$$

3. The toner classification apparatus according to claim 1, wherein the vane A has an elbow, and (vii) an angle θ4 formed by a straight line which connects the end portion on the side of the rotation center of the vane A and the elbow of the vane A and a straight line which connects the elbow of the vane A and the end portion on the side of the outer circumference of the vane A is 5 to 25°.

4. The toner classification apparatus according to claim 1, wherein the vane A has an elbow, and (viii) the vane B has a second elbow on a side of an outer circumference of the first elbow, a distance L4 between the rotation center of the classification rotor and the elbow of the vane A and a distance between the rotation center of the classification rotor and the second elbow of the vane B are substantially equal to each other, and an angle θ5 formed by a straight line which connects the first elbow of the vane B and the second elbow of the vane B and a straight line which connects the second elbow of the vane B and the end portion on the side of the outer circumference of the vane B is substantially equal to an angle θ4 formed by a straight line which connects the end portion on the side of the rotation center of the vane A and the elbow of the vane A and a straight line which connects the elbow of the vane A and the end portion on the side of the outer circumference of the vane A.

5. The toner classification apparatus according to claim 1, wherein an interval at the end portions on the side of the outer circumference of the vane A and the vane B is 5.0 to 25.0 mm.

6. The toner classification apparatus according to claim 1, further comprising:

a main body casing;

guide means disposed in a state of overlapping at least a portion of the classification rotor;

an introduction port for particles to be classified and supply means for the particles to be classified which comprises the introduction port for particles to be classified, these being formed in a side surface of the body casing to introduce the particles to be classified;

a particles having too small diameter discharge port and a classified particle take-off port, these being formed in a side surface of the body casing to discharge, to outsider of the body casing, classified particles from which the particles having too small diameter have been excluded; and a dispersion rotor which is a rotating body attached, within the body casing, to a central rotational axle and which comprises a dispersion hammer on the surface of the classification rotor side of the dispersion rotor.

7. The toner classification apparatus according to claim 6, further comprising:

a liner which is disposed in a fixed manner at the circumference of the dispersion rotor while maintaining a distance therefrom.

8. The toner classification apparatus according to claim 7, wherein grooves are disposed in a surface of the liner, the surface facing the dispersion rotor.

9. A toner production method comprising a classification step of carrying out a classification process on particles to be classified by using a toner classification apparatus, wherein the toner classification apparatus comprising:

a classification rotor; wherein the classification rotor comprises a plurality of vanes which extend from a rotation center direction of the classification rotor to an outer circumference direction of the classification rotor, the plurality of vanes are disposed with prescribed gaps established between the vanes;

the gaps form an opening which faces a rotation center area of the classification rotor;

the plurality of vanes comprise a first vane group constituted by a vane A and a second vane group constituted by a vane B having a length longer than a length of the vane A, the lengths of the vanes A are substantially identical to each other and the vanes A are disposed at an interval so as to follow paths which are substantially identical to each other during rotation of the classification rotor, the lengths of the vanes B are substantially identical to each other and the vanes B are disposed at an interval so as to follow paths which are substantially identical to each other during the rotation of the classification rotor, a number of the vanes A which are disposed between two adjacent vanes B is one to three, the vane B has a first elbow, the vane A and the vane B are disposed such that a portion of a vane away from of the rotation center of the classification rotor is located on more upstream direction in a direction of rotation of the classification rotor than a portion of the vane closer to the rotation center of the classification rotor, a distance between the rotation center of the classification rotor and the end portion on the side of the outer circumference of the vane A and a distance between the rotation center of the classification rotor and the end portion on the side of the outer circumference of the vane B are substantially equal to each other, a distance between the rotation center of the classification rotor and the end portion on the side of the rotation center of the vane A and a distance between the rotation center of the classification rotor and the first elbow of the vane B are substantially equal to each other, the distance between the rotation center of the classification rotor and the end portion on the side of the rotation center of the vane A is more than a distance between the rotation center of the classification rotor and the end portion on the side of the rotation center of the vane B, and, in a cross section obtained when the classification rotor is cut in a direction perpendicular to a rotation axis of the classification rotor, (i) an angle θ1 (° ) formed by a straight line which connects the rotation center of the classification rotor and the end portion on the side of the rotation center of the vane A and a portion on the vane A which is closer to the side of the outer circumference than the end portion on the side of the rotation center of the vane A is 40 to 65°, (ii) an angle θ3 (° ) formed by a straight line which connects the rotation center of the classification rotor and the first elbow of the vane B and a portion on the vane B which is closer to the side of the outer circumference than the first elbow of the vane B is substantially identical to the angle θ1, (iii) an angle θ2 (° ) formed by the straight line which connects the rotation center of the classification rotor and the first elbow of the vane B and a straight line which connects the end portion on the side of the rotation center of the vane B and the first elbow of the vane B satisfies $$0° \leq \theta 2 \leq \theta 3 \times ½,$$

(iv) when a radius of the classification rotor is represented by R and the distance between the rotation center of the classification rotor and the end portion on the side of the rotation center of the vane B is represented by L1, the R and the L1 satisfy $$0.35 \leq L1/R \leq 0.65, \text{ and}$$

(v) when the distance between the rotation center of the classification rotor and the first elbow of the vane B is represented by L2, the R, the L1, and the L2 satisfy $$0.35 \leq (L2-L1)/(R-L1) \leq 0.70.$$

* * * * *